US009347464B2

(12) United States Patent
Weng et al.

(10) Patent No.: US 9,347,464 B2
(45) Date of Patent: May 24, 2016

(54) HEATING AND VENTILATION FAN FOR BATHROOM

(75) Inventors: Yefan Weng, Guangdong (CN); Liang Tian, Guangdong (CN); Hongjian Yuan, Guangdong (CN); Shuang Jin, Guangdong (CN); Makoto Ishikawa, Aichi (JP); Takuya Arai, Aichi (JP)

(73) Assignees: Panasonic Ecology Systems Guandong Co. Ltd., Foshan Gangdon (CN); Panasonic Corporation, Osaka (JP)

( * ) Notice: Subject to any disclaimer, the term of this patent is extended or adjusted under 35 U.S.C. 154(b) by 808 days.

(21) Appl. No.: 13/574,737

(22) PCT Filed: Feb. 10, 2011

(86) PCT No.: PCT/CN2011/000207

§ 371 (c)(1),
(2), (4) Date: Aug. 14, 2012

(87) PCT Pub. No.: WO2011/113296

PCT Pub. Date: Sep. 22, 2011

(65) Prior Publication Data

US 2013/0004299 A1 Jan. 3, 2013

(30) Foreign Application Priority Data

Mar. 15, 2010 (CN) ..... 2010 1 0127188

(51) Int. Cl.
*F04D 29/58* (2006.01)
*F04D 17/16* (2006.01)
(Continued)

(52) U.S. Cl.
CPC ..... *F04D 29/5826* (2013.01); *F04D 17/16* (2013.01); *F04D 27/009* (2013.01); *F24F 7/007* (2013.01); *F24F 13/14* (2013.01); *F24F 2013/205* (2013.01); *F24F 2221/34* (2013.01)

(58) Field of Classification Search
CPC ..... F04D 29/422; F04D 29/442; F04D 29/46; F04D 29/462; F04D 29/464; F04D 25/08; F04D 25/10; F24F 7/007; F24F 7/08; F24F 13/14
See application file for complete search history.

(56) References Cited

U.S. PATENT DOCUMENTS 5,839,879 A 11/1998 Kameoka et al.
2009/0275280 A1 11/2009 Liang et al.

FOREIGN PATENT DOCUMENTS

CN 101576095 11/2009
JP 07171299 A * 7/1995 ..... D06F 58/10
(Continued)

OTHER PUBLICATIONS

Koyabu, Koichi; Bathroom Ventilating Dryer; Jul. 11, 1995; Machine translation of JP 07-171299 "Bathroom Ventilating Dryer".*
(Continued)

*Primary Examiner* — Nathaniel Wiehe
*Assistant Examiner* — Jason Davis
(74) *Attorney, Agent, or Firm* — RatnerPrestia

(57) ABSTRACT

A heating and ventilation fan for a bathroom comprises an ventilation fan frame, a scroll casing provided with fan blades and a motor, an air passage-switching plate, and a heater; characterized in that: an air leakage-preventing structure is provided between an air outlet of the scroll casing and the air passage. The advantage of the present invention is that a desired air amount can be ensured and a noise can be reduced while guaranteeing a gap required for smooth rotation of the air passage-switching plate.

19 Claims, 21 Drawing Sheets

(51) Int. Cl.

| | |
|---|---|
| ***F04D 27/00*** | (2006.01) |
| ***F24F 7/007*** | (2006.01) |
| ***F24F 13/10*** | (2006.01) |
| ***F24F 13/14*** | (2006.01) |
| *F24F 13/20* | (2006.01) |

(56) References Cited

FOREIGN PATENT DOCUMENTS

| | | | | | |
|---|---|---|---|---|---|
| JP | 9-250787 | | | 9/1997 | |
| JP | 9250787 | | | 9/1997 | |
| JP | 10-073294 | | | 3/1998 | |
| JP | 2003-279116 | | | 10/2003 | |
| JP | 2004003722 | A | * | 1/2004 | ..... F24F 1/00 |
| JP | 2004301481 | A | * | 10/2004 | ..... F24F 7/10 |
| JP | 2010-054077 | | | 3/2010 | |

OTHER PUBLICATIONS

Kurashima et al; Bathroom Drier; Jan. 8, 2004; Machine Translation of JP 2004-003722 "Bathroom Drier".*

Ishikawa et al; Bathroom Ventilation and Drying Device; Oct. 28, 2004; English Abstract of JP 2004-301481 "Bathroom Ventilation and Drying Device".*

Hirohiko et al; Bathroom Ventilating Dryer; Sep. 22, 1997; Machine Translation of JP 9-250787 "Bathroom Ventilating Dryer".*

International Search Report corresponding to International Application No. PCT/CN2011/000207, dated May 19, 2011.

Chinese First Office Action with English Translation, dated Sep. 28, 2012.

Chinese Second Office Action with English Translation, dated Apr. 2, 2013.

* cited by examiner

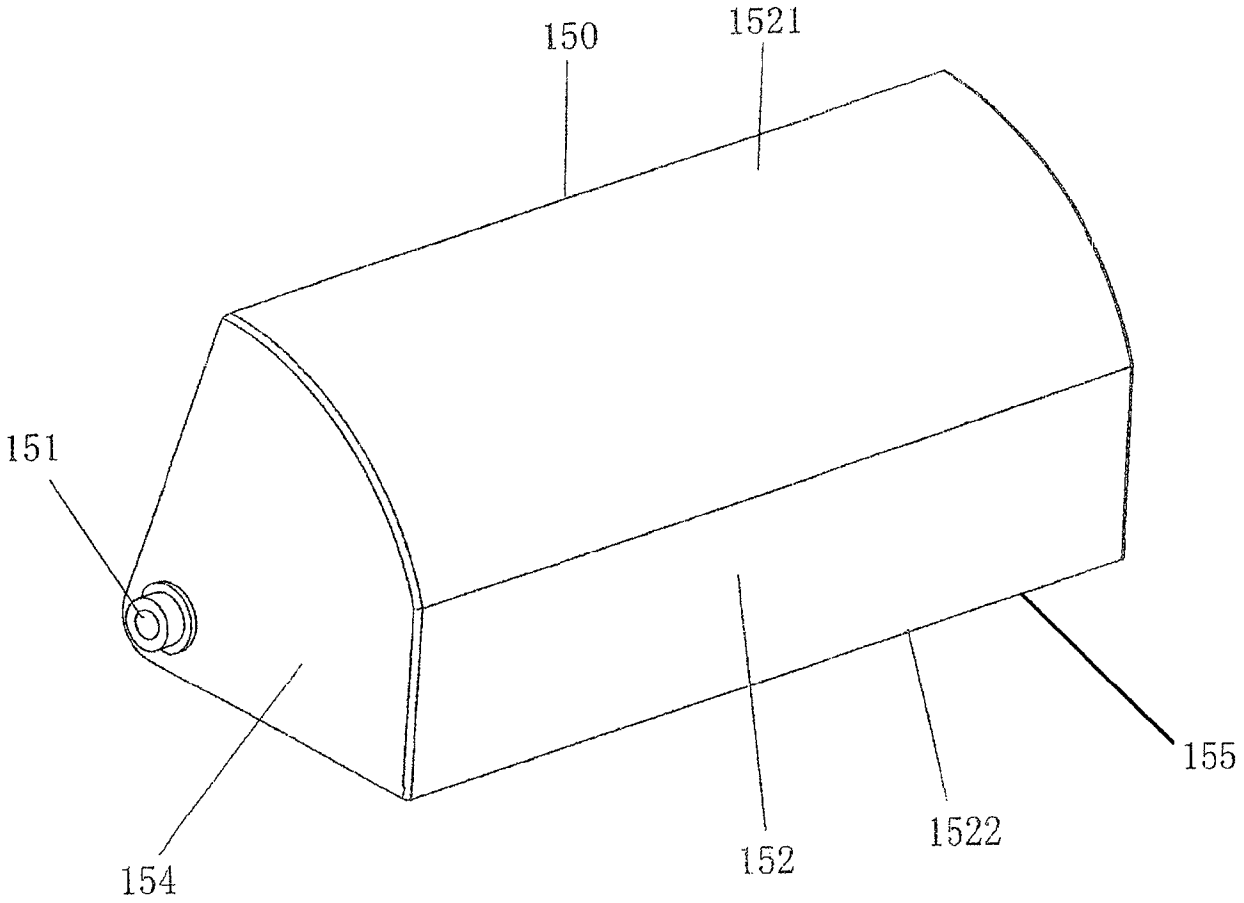
Fig, 2D

HEATING AND VENTILATION FAN FOR BATHROOM

This application is the U.S. National Phase Application of PCT International Application No. PCT/CN2011/000207, filed Feb. 10, 2011, the contents of such applications being incorporated by reference herein.

FIELD OF THE INVENTION

The present invention relates to a heating and ventilation fan for a bathroom, and in particular, to an air leakage-preventing structure for a heating and ventilation fan for a bathroom.

DESCRIPTION OF THE RELATED ART

As shown in FIG. 1, a heating and ventilation fan 100 for a bathroom in the prior art comprises a frame 110 having an opening 101 open toward the bathroom and an opening 102 connected with a joint, an ventilation fan profile constituted by a hood 110*a* for covering the opening 101 at the lower side of the frame 110, fan blades 120, a motor 130, a heater 140 and an air passage-switching plate 150. When the heating and ventilation fan 100 is operated, the air is drawn from an air inlet 160 of the hood 110*a* of the heating and ventilation fan 100 toward the air passage-switching plate 150. The air passages are switched by rotation of the air passage-switching plate 150, so that one of a heating function, an air-exchanging function, and a drying function of the heating and ventilation fan 100 is selected.

Since selection of the above functions should be performed by rotation of the air passage-switching plate 150, a certain gap 180 between the air passage-switching plate 150 and the air passage wall 170 should be ensured, and thus the air passage-switching plate 150 can be smoothly rotated. In this way, when the heating and ventilation fan 100 is operated, a small amount of the air is blown into the gap 180, causing lost of air volume and generation of noise. However, if the gap 180 between the air passage-switching plate 150 and the surrounding air passage wall 170 is too small, the small gap will cause noise when the air is blow into the gap or the air passage-switching plate 150 can not be smoothly rotated during operation of the heating and ventilation fan.

SUMMARY

Accordingly, it is desired to provide a heating and ventilation fan for a bathroom which is capable of reducing noise.

In order to achieve the above object, the heating and ventilation fan for a bathroom according to the present invention is an ventilation fan for a bathroom, comprising an ventilation fan frame, a scroll casing provided with fan blades and a motor, an air passage-switching plate provided downstream of an air outlet of the scroll casing and configured to switch air passages directed in at least two directions, and a heater. An air leakage-preventing structure is provided at the air outlet of the scroll casing to direct the air to an inside of the air passage-switching plate.

The air leakage-preventing structure comprises a protrusion piece configured to protrude from the air outlet of the scroll casing to the inside of the air passage-switching plate, and the air passage-switching plate has a rotation piece configured to overlap with the outer side of the protrusion piece.

An air passage wall forming an air passage extends from the air outlet of the scroll casing, and the protrusion piece and the air passage wall forming the air passage form a gap for receiving the rotation piece of the air passage-switching plate downstream of the air outlet of the scroll casing The protrusion piece is provided at the periphery of the whole air outlet of the scroll casing.

The protrusion piece is protruded from a position higher than the position at which a rotation shaft, passing across the air outlet of the scroll casing, of the air passage-switching plate is located.

The protrusion piece is protruded from a position lower than the position at which a rotation shaft, passing across the air outlet of the scroll casing, of the air passage-switching plate is located.

The air leakage-preventing structure comprises protruding structures provided on the air passage-switching plate and on the air passage wall forming the air passage and operable to be engaged with each other.

The protruding structures comprise protrusions provided on the left and right sides of the air passage-switching plate and of the air passage wall, respectively, and the protrusions on the air passage-switching plate and the protrusions on the air passage wall can be engaged with each other.

The protrusions of the air passage-switching plate comprise a first air passage-switching plate protrusion and a second air passage-switching plate protrusion provided on side plates of the air passage-switching plate adjoining the air passage wall, respectively, and the protrusions of the air passage wall comprise a first air passage wall protrusion provided at the middle of the air passage wall.

The protrusions of the air passage-switching plate comprise a third air passage-switching plate protrusion and a fourth air passage-switching plate protrusion provided on a front end portion and a rear end portion of the air passage-switching plate adjoining the air passage wall, respectively, and the protrusions of the air passage wall comprise a second air passage wall protrusion provided at the middle of the air passage wall on the air outlet side.

A third air passage wall protrusion is provided on a top surface side of the air passage wall, and the lowest point of the third air passage-switching plate protrusion is higher than the lowest point of the third air passage wall protrusion.

The advantage of the present invention is that a desired air volume can be ensured and a noise can be reduced while guaranteeing a gap required for smooth rotation of the air passage-switching plate.

Further, the present invention comprises the following structures:

a control unit for controlling the motor, the heater, and the air passage-switching plate and a sensor for detecting the position of the air passage-switching plate and sending a signal to the control unit are provided.

The sensor comprises a first body-side sensing element provided on the side face of the air passage wall of the scroll casing and a first air passage switching plate-side sensed element provided outside of a rotation piece of the air passage-switching plate and provided at a position corresponding to the position of the first body-side sensing element.

The first body-side sensing element is provided to correspond to movable limit points of the first air passage switching plate-side sensed elements moved along with the air passage-switching plate.

The sensor comprises a second body-side sensing element provided on the top portion of the air passage wall of the scroll casing and a second air passage switching plate-side sensed element provided outside of a rotation piece of the air passage-switching plate and located at a position corresponding to the position of the second body-side sensing element.

The sensor comprises a third body-side sensing element provided on the bottom portion of the air passage wall of the scroll casing and a third air passage switching plate-side sensed element provided outside of a rotation piece of the air passage-switching plate and located at a position corresponding to the position of the third body-side sensing element.

The first, second, and third body-side sensing elements are magnetic sensors, and the first, second, and third air passage switching plate-side sensed elements are magnets.

The magnetic sensors are electromagnets.

With the above structure, a necessary space required for smooth rotation of the air passage-switching plate and a desired air volume can be ensured and a noise can be reduced. Furthermore, since the position of the air passage-switching plate can be detected by the sensor, in a case where the position of the air passage-switching plate offsets from the normal position due to external factors during the heating operation or the air-exchanging operation, the control unit can be used to correct the position of the air passage-switching plate.

BRIEF DESCRIPTION OF THE DRAWINGS

FIGS. 2A, 2B, 2C, and 2D are schematic views of a first embodiment;

DETAILED DESCRIPTION

Figure 1:
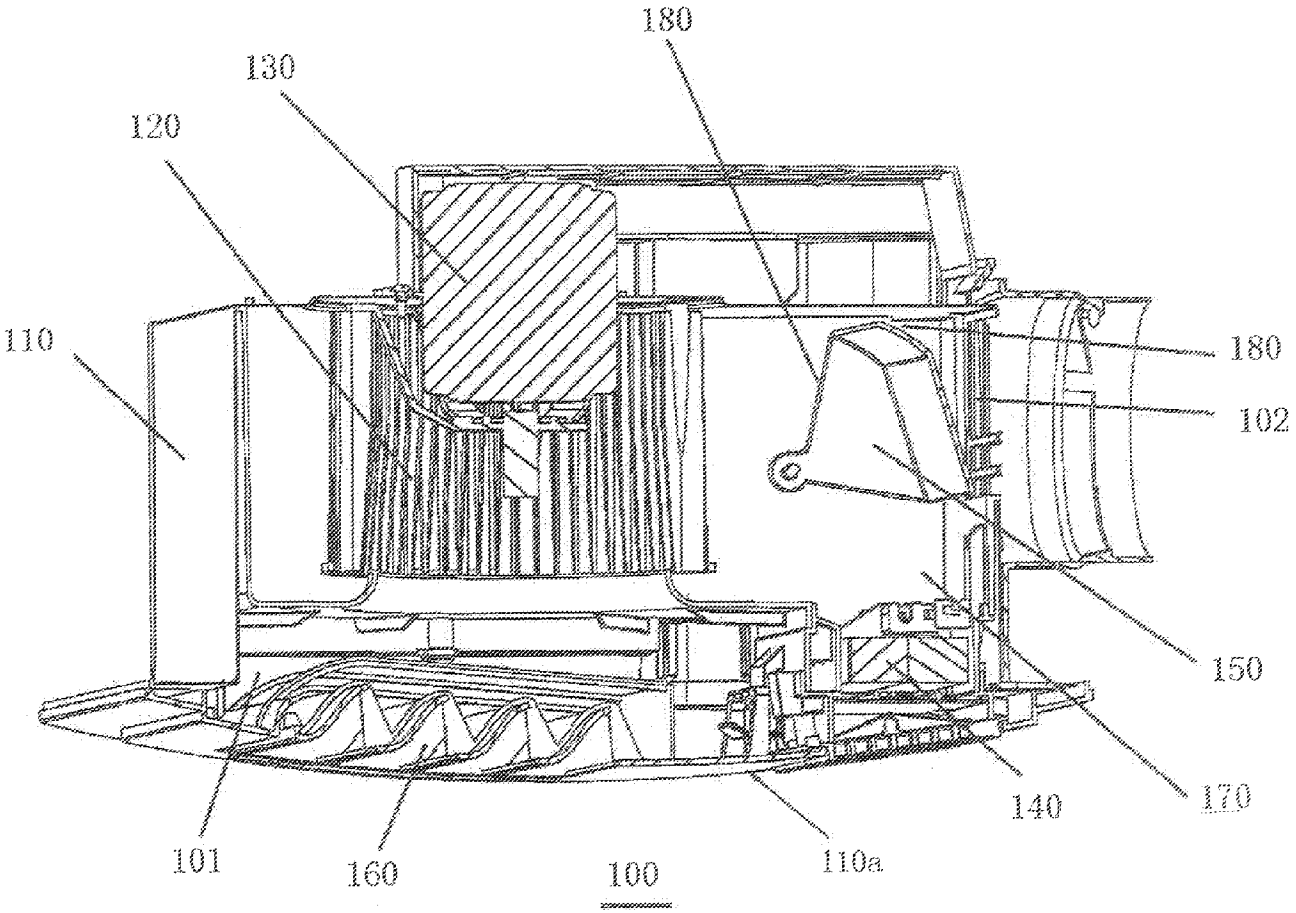
Fig. 1 PRIOR ART
FIG. 1 is a schematic view of the prior art.
Figure 2A:
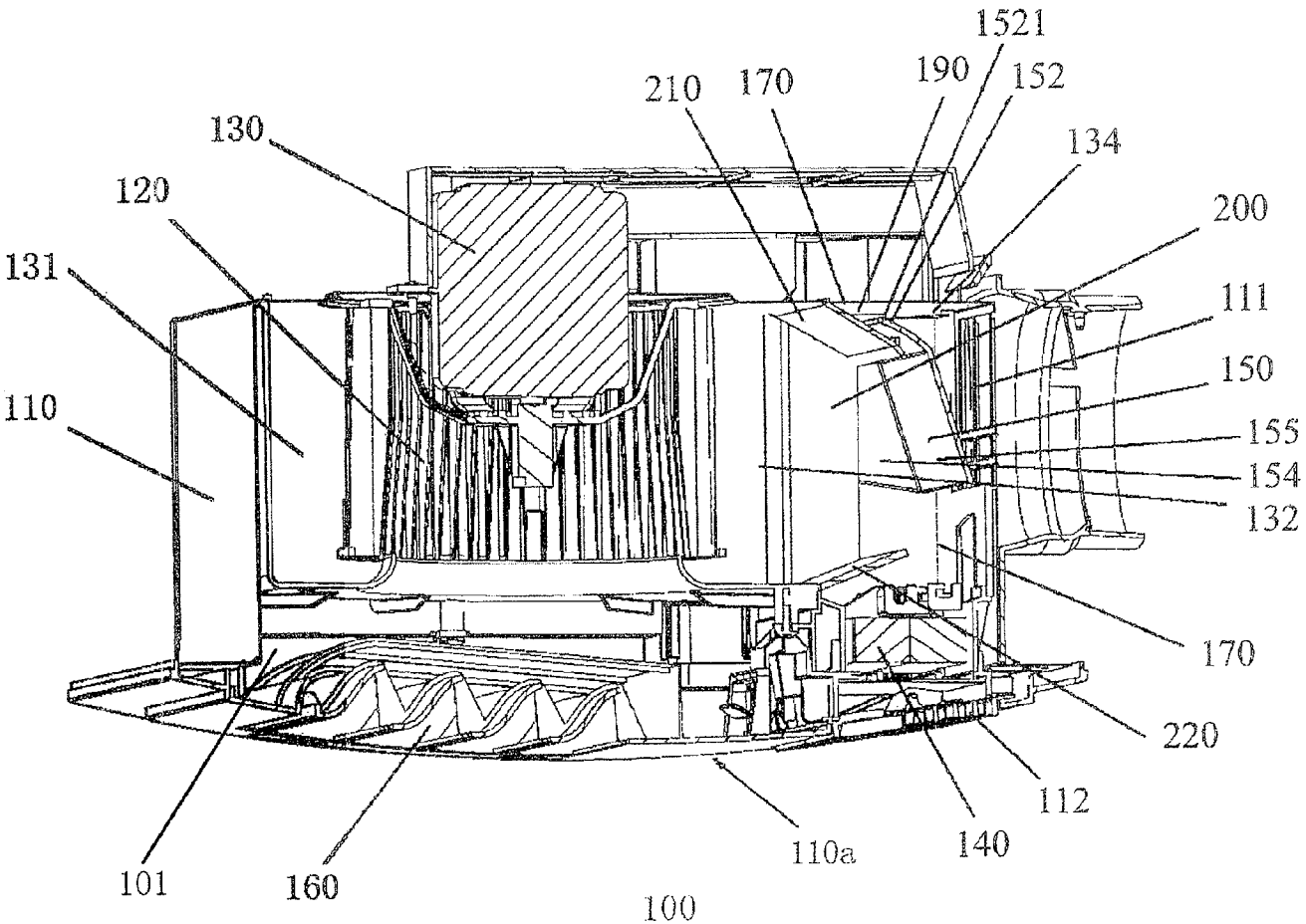

With reference to FIGS. 2A, 2B, 2C, and 2D, schematic views of a first embodiment of the present invention are shown. As shown in FIG. 2A, a heating and ventilation fan 100 for a bathroom comprises an ventilation fan frame 110, an ventilation fan appearance formed by a hood 110*a* for covering an opening 101 positioned at the lower side of the ventilation fan frame 110, a scroll casing 131 provided with fan blades 120 and a motor 130, an air passage-switching plate 150, a heater 140, and so on. A side wall of the ventilation fan frame 110 is provided with an air outlet 111. The hood 110*a* has an air inlet 160 and an indoor air outlet 112. The scroll casing 131 has an air outlet 132 in a square-tube shape defined by a top wall, side walls, and a bottom wall. The body of the heating and ventilation fan 100 has an air passage from the air outlet 132 to the air outlet 111 provided in the side wall of the ventilation fan frame 100 and an air passage from the air outlet 132 to the indoor air outlet 112 provided at the hood and through which air is blown toward the indoor.

Figure 2B:
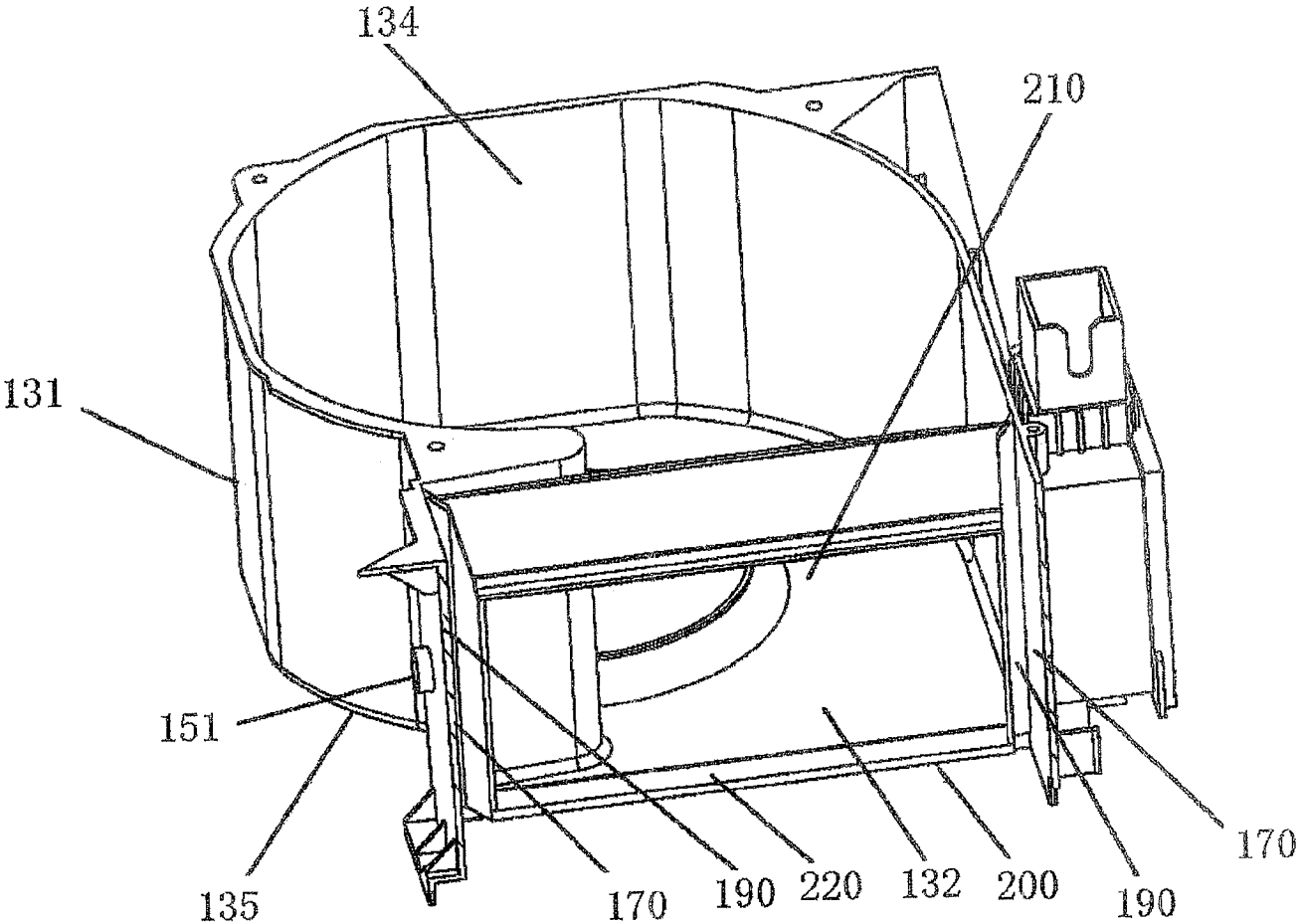

As shown in FIGS. 2B and 2D, the air passage-switching plate 150 comprises a rotation shaft 151 passing across the air outlet 132 of the scroll casing. Around the rotation shaft 151, a main plate 152 configured to switch the air passages and a rotation piece 155 configured to drive the main plate 152 to continuously rotate toward the rotation shaft and having side plates 154 are provided. The air passage-switching plate 150 is provided downstream of the air outlet 132 of the scroll casing 131. The air outlet 132 is switched to two directions, that is, to the above-mentioned two air passages according to the position of the main plate 152. At the air outlet 132 of the scroll casing 131, an air leakage-preventing structure for guiding the air to an inside of the air passage-switching plate 150 is provided.

The air leakage-preventing structure shown in FIG. 2B is a protrusion piece 200 configured to protrude from the periphery of the whole air outlet 132 of the scroll casing 131 to an inside of the air passage-switching plate 150. The rotation piece (not shown in FIGS.) of the air passage-switching plate 150 and the outer side of the protrusion piece 200 overlap with each other.

As shown in FIGS. 2A and 2B, an air passage wall 170 for forming the air passages extends from the air outlet 132 of the scroll casing 131 to the indoor air outlet 112, through which the air is blown toward the indoor, and the air outlet 111 of the ventilation fan. There is a certain gap 190 downstream of the air outlet 132 of the scroll casing 131 between the protusion piece 200 and the air passage wall 170. The gap 190 receives the rotation piece 155 of the air passge-switching plate 150.

An air passage wall 170 for forming the air passages extends from the air outlet 132 of the scroll casing 131 to the indoor air outlet 112, through which the air is blown toward the indoor, and the air outlet 111 of the ventilation fan. There is a certain gap 190 downstream of the air outlet 132 of the scroll casing 131 between the protrusion piece 200 and the air passage wall 170. The gap 190 receives the rotation piece 155 of the air passage-switching plate 150.

The protrusion piece 200 protrudes from the periphery of the whole air outlet 132 toward an inside of the air passage to form a "□" shape. The "□" shape is divided by the rotation shaft 151 of the air passage-switching plate 150 as a boundary into an upper portion and a lower portion, of which the portion close to the top surface 134 of the scroll casing 131 is the upper portion 210 of the protrusion piece 200, and the portion close to the bottom surface 135 of the scroll casing 131 is the lower portion 220 of the protrusion piece 200.

The heating and ventilation fan 100 for a bathroom realizes selection among a heating function, an air-exchanging function and a drying function of the heating and ventilation fan 100 by controlling a rotation position of the air passage-switching plate 150.

With reference to FIG. 2A again, a sectional view of the heating and ventilation fan 100 for a bathroom in a heating mode is shown. By control of a step motor, the air passage-switching plate 150 is rotated to the top surface 134 side of the scroll casing 131. The side plates 154 on the two sides of the air passage-switching plate 150 and a front end portion 1521 of the main plate 152 are inserted into the gap 190 between the upper portion 210 of the protrusion piece 200 and the air passage wall 170 from a downstream side of the air outlet 132. That is to say, the upper portion 210 of the protrusion piece 200 and the air passage wall 170 form a structure for receiving the side plates 154 on the two sides of the air passage-switching plate 150 and the front end portion 1521 of the main plate 152. When the heating and ventilation fan 100 operates, the air is sucked from the air inlet 160 of the heating and ventilation fan, passes through the fan blades 120, and are blown out from the air outlet 132 of the scroll casing 131 toward the heater 140. With such a structure, the air can be prevented from directly flowing out from the gap between the air passage-switching plate 150 and the air passage wall 170.

That is to say, the protrusion piece 200 is provided downstream of the scroll casing 131, and the outer side of the protrusion piece 200 and the air passage-switching plate 150 overlap with each other to form a receiving structure, so that the air blown out of the scroll casing 131 will not leak to outside of the air passage-switching plate 150 but will be guided into the air passage-switching plate 150. Finally, the air can flow to one of the two air passages from the air outlet 132 to the indoor air outlet 112 through which air is blown toward the indoor.

Figure 2C:
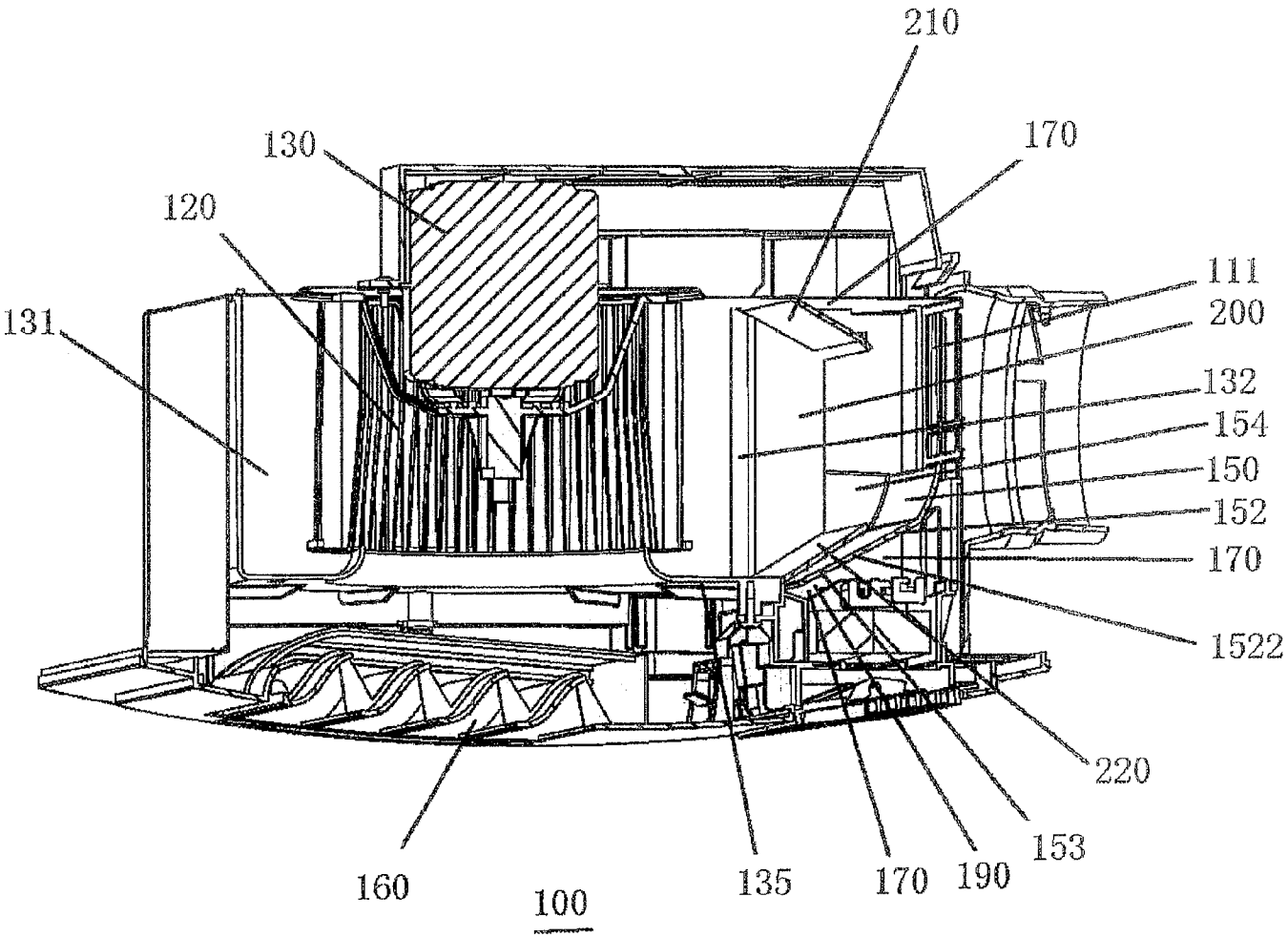

With reference to FIG. 2C, a sectional view of the heating and ventilation fan 100 for a bathroom in an air-exchanging mode is shown. By control of the step motor, the air passage-switching plate 150 is rotated to the bottom surface 135 side of the scroll casing 131. The side plates 154 on the two sides of the air passage-switching plate 150 and a rear end portion 1522 are inserted into the gap 190 between the lower portion 220 of the protrusion piece 200 in a "□" shape and the air passage wall 170 from the downstream side of the air outlet 132. That is to say, the lower portion 220 of the protrusion piece 200 and the air passage wall 170 form a structure for receiving the side walls 154 on the two sides of the air passage-switching plate 150 and the rear end portion 1522 of the main plate 152. When the heating and ventilation fan 100 operates, the air is sucked from the air inlet 160 of the heating and ventilation fan, passes through the fan blades 120, and are blown out from the air outlet 132 of the scroll casing 131 toward the air outlet 111. With such a structure, the air can be prevented from directly flowing out from the gap between the air passage-switching plate 150 and the air passage wall 170.

That is to say, the protrusion piece 200 is provided downstream of the scroll casing 131, and the outer side of the protrusion piece 200 and the lower portion 220 of the air passage-switching plate 150 overlap with each other to form a receiving structure, so that the air blown out of the scroll casing 131 will not leak to outside of the air passage-switching plate 150 but will be guided into the air passage-switching plate 150. Finally, the air can flows to one of the two air passages from the air outlet 132 to the air outlet 111 of the ventilation fan.

As described above, when the air passage-switching plate 150 is rotated, there is a gap between the air passage wall 170 and the portions, contacting with the air passage wall 170, of the air passage-switching plate 15. By providing an air leakage-preventing structure, i.e., the protrusion piece 200 in a "□" shape, between the air outlet 132 of the scroll casing 131 and the air passages to cover the gap between the air passage-switching plate 150 and the air passage wall 170 from an upstream side of the air flow, the air can be prevented from being blown into the gap between the air passage-switching plate 150 and the air passage wall 170, so that generation of noise and undesired rotation of the air passage-switching plate 150 can be prevented and the desired air volume can be ensured. In this way, performance of products and utilization efficiency of energy can be improved.

Figure 3A:
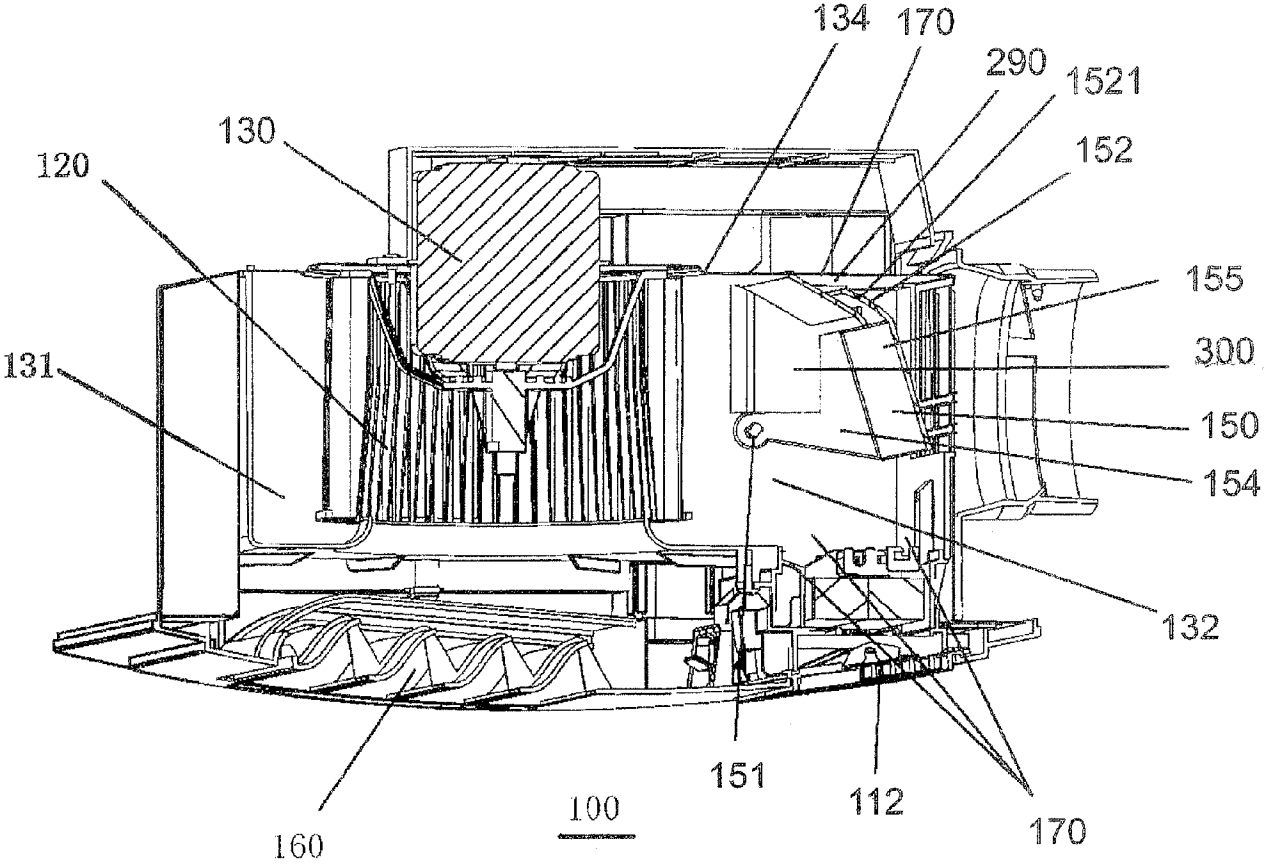
FIGS. 3A and 3B are schematic views of a second embodiment.
Figure 3B:
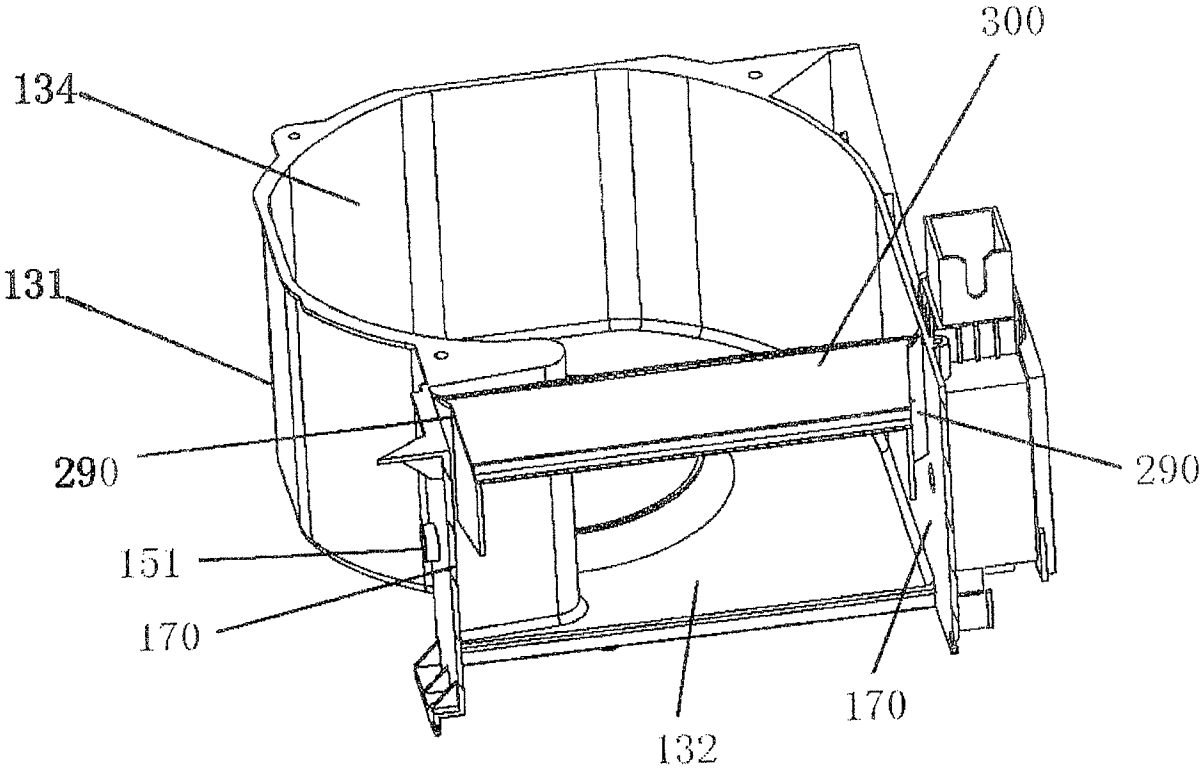

FIGS. 3A and 3B show sectional views of a second embodiment of the present invention. Downstream of the air outlet 132 of the scroll casing 131, the air passage wall 170 extends, and a protrusion piece 300 protruded from the air outlet 132 of the scroll casing 131 toward a downstream side and the inner side of the air passage wall 170 form a certain gap 290.

The protrusion piece 300 is provided at an upper location than the rotation shaft 151 of the air passage-switching plate 150 for the air outlet 132 of the scroll casing 131, i.e., forming an inverse "U" shape.

At a certain rotation position, the side plates 154 on the two sides of the air passage-switching plate 150 and a front end portion 1521 of the main plate 152 are received by the gap 290 formed between the outer side of the protrusion piece 300 and the air passage wall 170.

With reference to FIG. 3A again, a sectional view of the heating and ventilation fan 100 for a bathroom in a heating mode is shown. By control of a step motor, the air passage-switching plate 150 is rotated to the top surface 134 side of the scroll casing 131. The side plates 154 on the two sides of the air passage-switching plate 150 and the front end portion 1521 of the main plate 152 are inserted from a downstream side in a direction of the air flow into the gap 290 between the protrusion piece 300 in an inverse "U" shape and the air passage wall 170. The protrusion piece 300 and the air passage wall 170 form a structure for receiving the side plates 154 on the two sides of the air passage-switching plate 150 and the front end portion 1521 of the main plate 152. When the heating and ventilation fan 100 operates, the air is sucked from the air inlet 160 of the heating and ventilation fan 100, passes through the fan blades 120, and is blown out from the air outlet 132 of the scroll casing 131 toward the heater 140. With such a structure, the air can be prevented from directly flowing out from the gap between the air passage-switching plate 150 and the air passage wall 170.

That is to say, the protrusion piece 300 protrudes toward the downstream side of the scroll casing 131, and the outer side of the protrusion piece 300 and the air passage-switching plate 150 overlap with each other to form a receiving structure, so that the air blown out of the scroll casing 131 will not leak out and will be guided into the air passage-switching plate 150. Finally, the air can flow to one of the two air passages from the air outlet 132 to the indoor air outlet 112 through which air is blown toward the indoor. In this way, performance of products and utilization efficiency of energy can be improved.

Figure 4A:
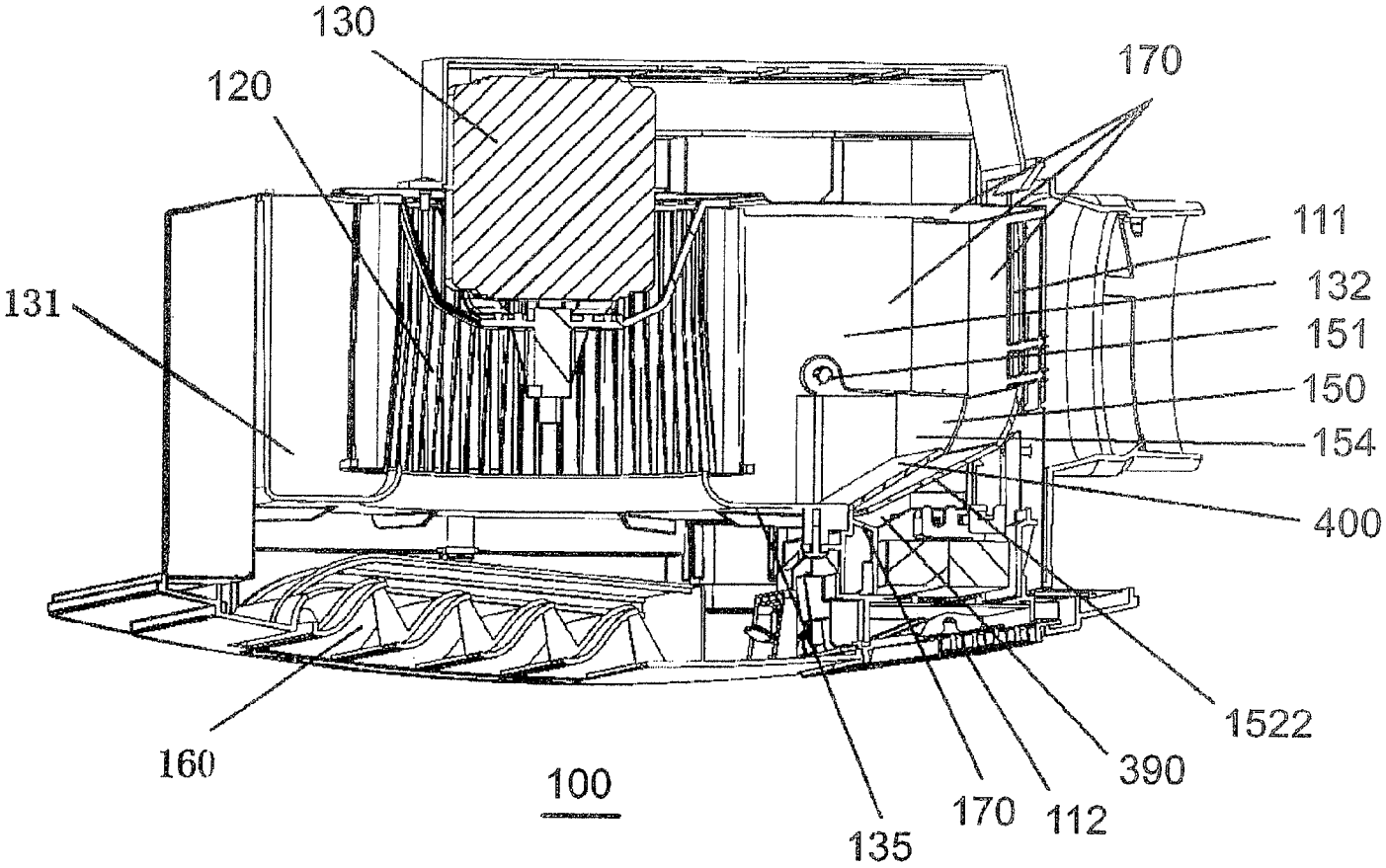
FIGS. 4A and 4B are schematic views of a third embodiment.
Figure 4B:
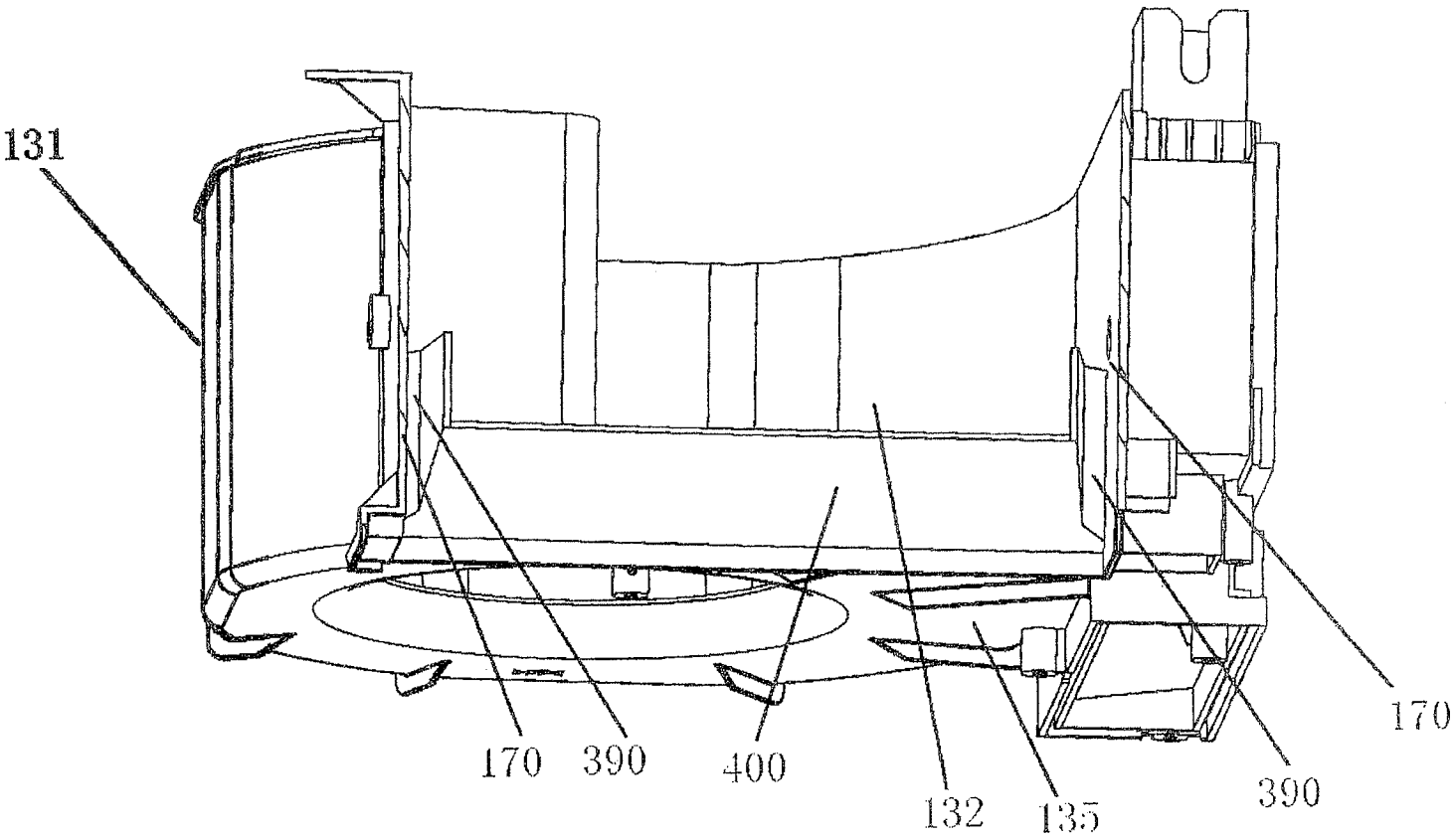

FIGS. 4A and 4B show sectional views of a third embodiment of the present invention. Downstream of the air outlet 132 of the scroll casing 131, the air passage wall 170 extends, and a protrusion piece 400 protruded from the air outlet 132 of the scroll casing 131 toward a downstream side and the inner side of the air passage wall 170 form a certain gap 390.

The protrusion piece 400 is provided at a lower location than the rotation shaft 151 of the air passage-switching plate 150 for the air outlet 132 of the scroll casing 131, i.e., forming a "U" shape.

At a certain rotation position, the air passage-switching plate 150 is received by the gap 390 formed between the outer side of the protrusion piece 400 and the air passage wall 170.

With reference to FIG. 4A again, a sectional view of the heating and ventilation fan 100 for a bathroom in an air-exchanging mode is shown. By control of a step motor, the air passage-switching plate 150 is rotated to the bottom surface 135 side of the scroll casing 131. The side plates 154 on the two sides of the air passage-switching plate 150 and a rear end portion 1522 are inserted from a downstream side in a direction of the air flow into the gap 390 between the protrusion piece 400 in a "U" shape and the air passage wall 170. The protrusion piece 400 and the air passage wall 170 form a structure for receiving the side plates 154 on the two sides of the air passage-switching plate 150 and the rear end portion 1522. When the heating and ventilation fan 100 operates, the air is sucked from the air inlet 160 of the heating and ventilation fan 100, passes through the fan blades 120, and is blown out from the air outlet 132 of the scroll casing 131 toward the air outlet 111. With such a structure, the air can be prevented from directly flowing out from the gap between the air passage-switching plate 150 and the air passage wall 170.

That is to say, the protrusion piece 400 is provided to protrude toward the downstream side of the scroll casing 131, and the outer side of the protrusion piece 400 and the air passage-switching plate 150 overlap with each other to form a receiving structure, so that the air blown out of the scroll casing 131 will not leak out and will be guided into the air passage-switching plate 150. Finally, the air can flow to one of the two air passages from the air outlet 132 to the air outlet 111 of the ventilation fan. In this way, performance of products and utilization efficiency of energy can be improved.

Figure 5A:
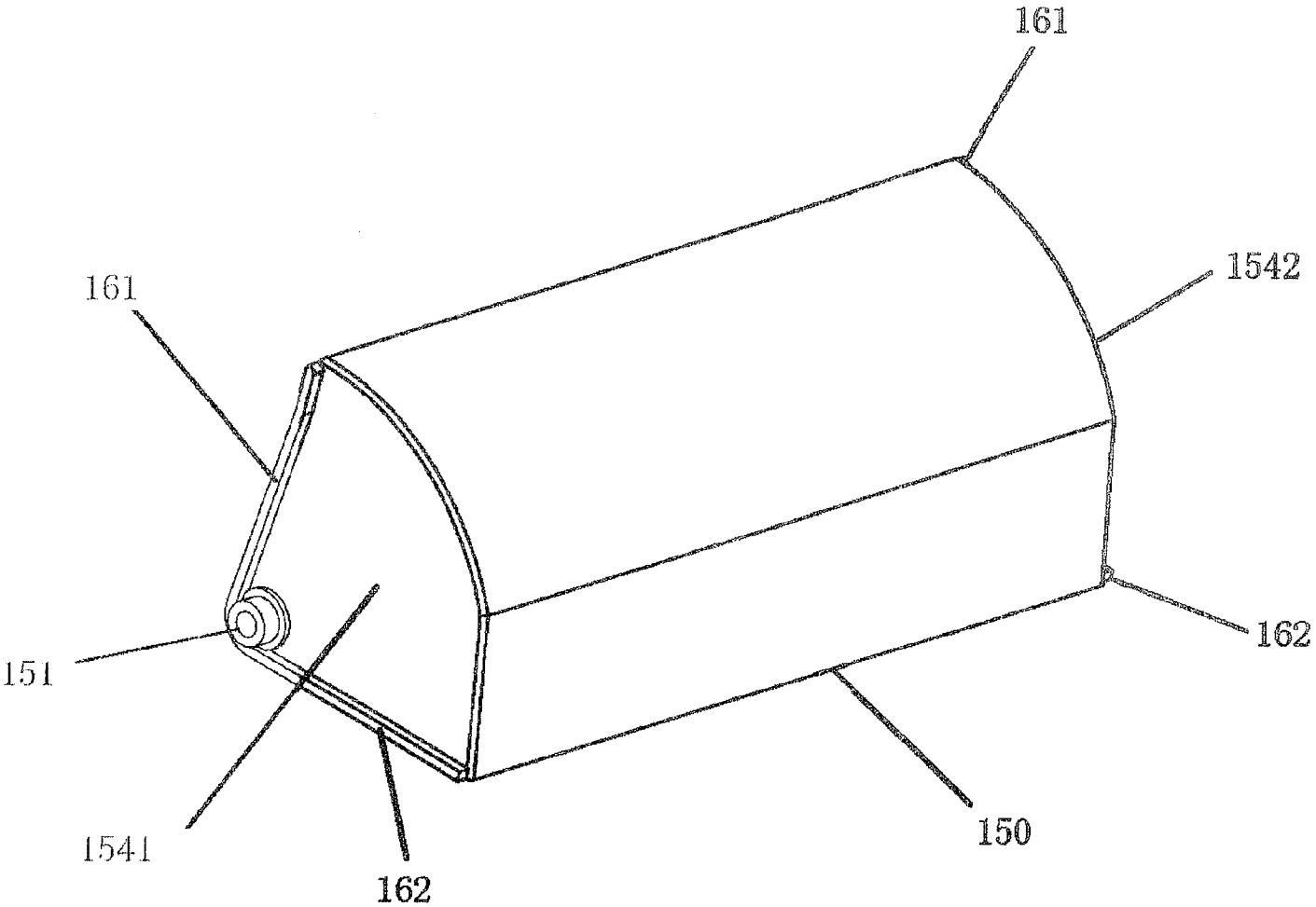
FIGS. 5A, 5B, 5C, and 5D are schematic views of a fourth embodiment.
Figure 5B:
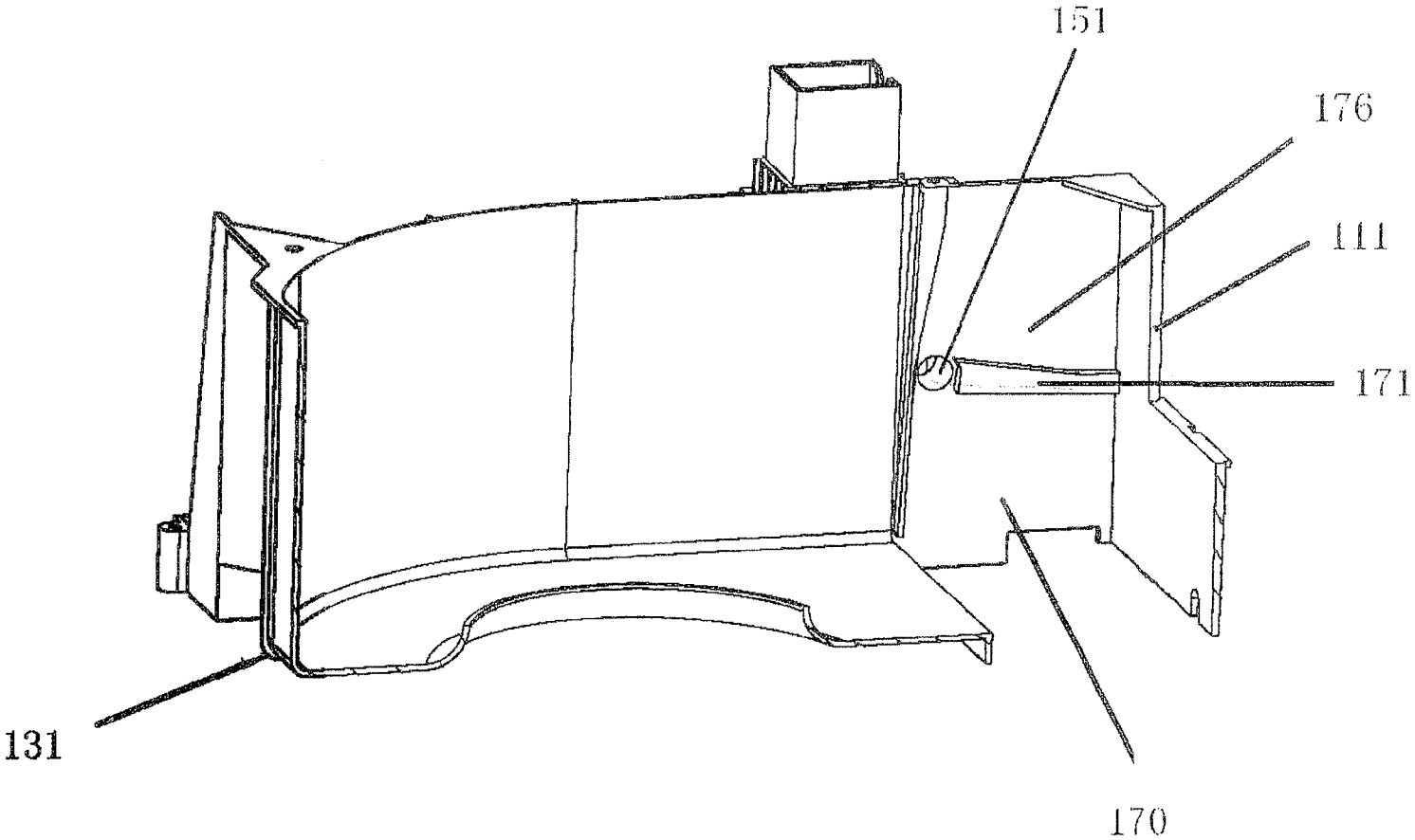

FIGS. 5A, 5B, 5C, and 5D show sectional views of a fourth embodiment of the present invention. As shown in FIGS. 5A and 5B, the side plates 154 of the air passage-switching plate 150 are provided with a pair of a first air passage-switching plate protrusion 161 and a second air passage-switching plate protrusion 162 on the left side surface 1541 and the right side surface 1542 of the side plates 154 facing the air passage wall 170, respectively. That is to say, the first air passage-switching plate protrusion 161 and the second air passage-switching plate protrusion 162 look like flanges on end surfaces of the side plates 154 of the air passage-switching plate 150 and radially extend from the rotation shaft 151.

The air passage wall 170 is provided with first air passage wall protrusions 171 at the middle positions on the left side and the right side 176 thereof, respectively. That is to say, the first air passage wall protrusions 171 are provided along a line from the rotation shaft 151 of the air passage-switching plate 150 to the lower end of the air outlet 111. Furthermore, the first air passage wall protrusions 171 are located between the first air passage-switching plate protrusion 161 and the second air passage-switching plate protrusion 162.

When the heating and ventilation fan 100 is operated in the air-exchanging mode or in the heating mode, the position of the air passage-switching plate 150 is set to separate the air passage from the air outlet 132 to the air outlet 111 of the ventilation fan provided on the side wall of the ventilation fan frame 110 from the air passage from the air outlet 132 to the indoor air outlet 112 provided at the hood and through which air is blown toward the indoor, by means of protruding structures formed by superposing the first air passage-switching plate protrusion 161 of the air passage-switching plate 150 and the first air passage wall protrusion 171 of the air passage wall 170 on each other and engaging the first air passage-switching plate protrusion 161 with the first air passage wall protrusion 171, or formed by superposing the second air passage-switching plate protrusion 162 and the first air passage wall protrusion 171 on each other and engaging the second air passage-switching plate protrusion 162 with the first air passage wall protrusion 171, so that the air can be prevented from directly flowing toward outside of the air passage-switching plate 150 from the gap between the air passage-switching plate 150 and the air passage wall 170.

The detailed description is provided as follows.

Figure 5C:
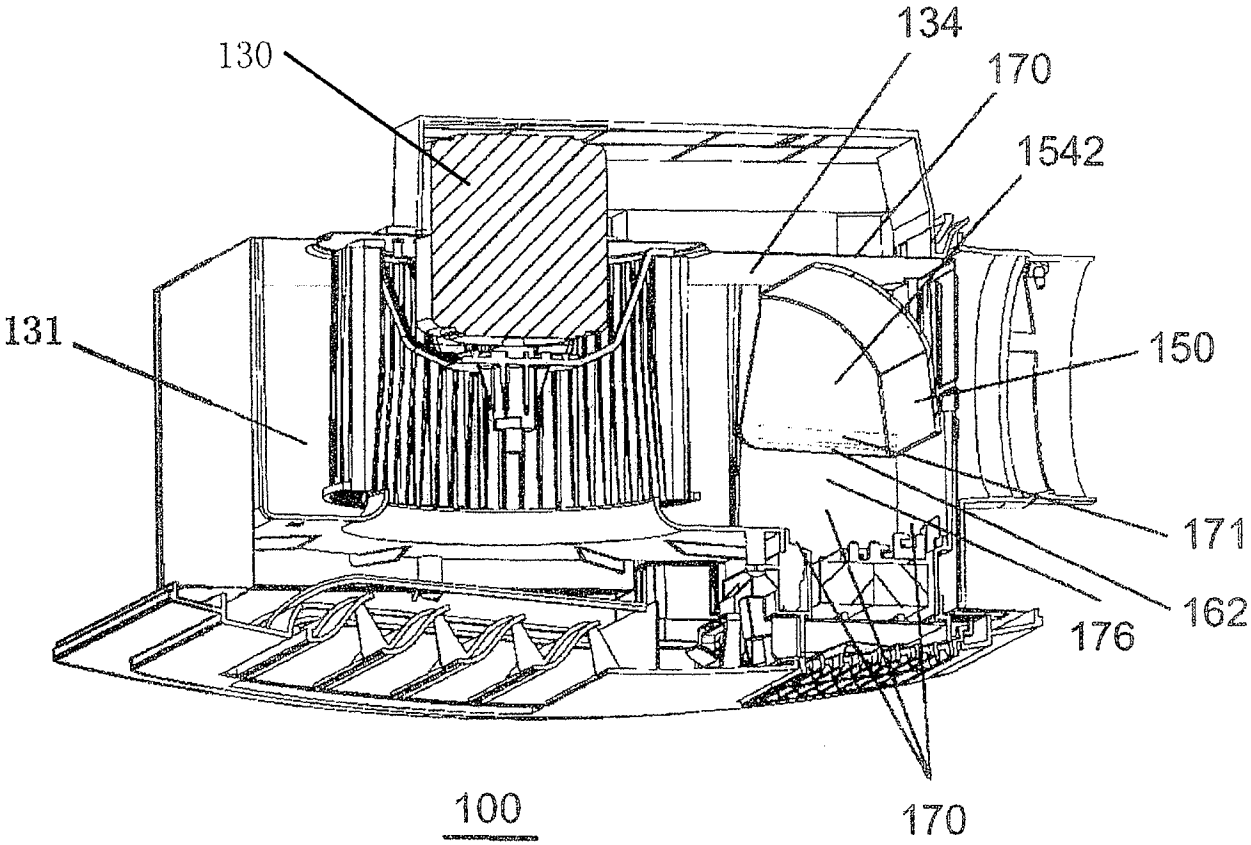

With reference to FIG. 5C, a sectional view of the heating and ventilation fan 100 for a bathroom in a heating mode is shown. By control of a step motor, the air passage-switching plate 150 is rotated to the top surface 134 side of the scroll casing 131. At this point, the second air passage-switching plate protrusions 162 provided on the left side surface (not shown) and the right side surface 1542 of the air passage-switching plate 150 engage with the first air passage wall protrusions 171 provided on the left side (not shown) and the right side 176 of the air passage wall 170, respectively, to form a tight engagement state, so that the air can be prevented from directly flowing toward outside of the air passage-switching plate 150 from the gap between the air passage-switching plate 150 and the air passage wall 170.

Figure 5D:
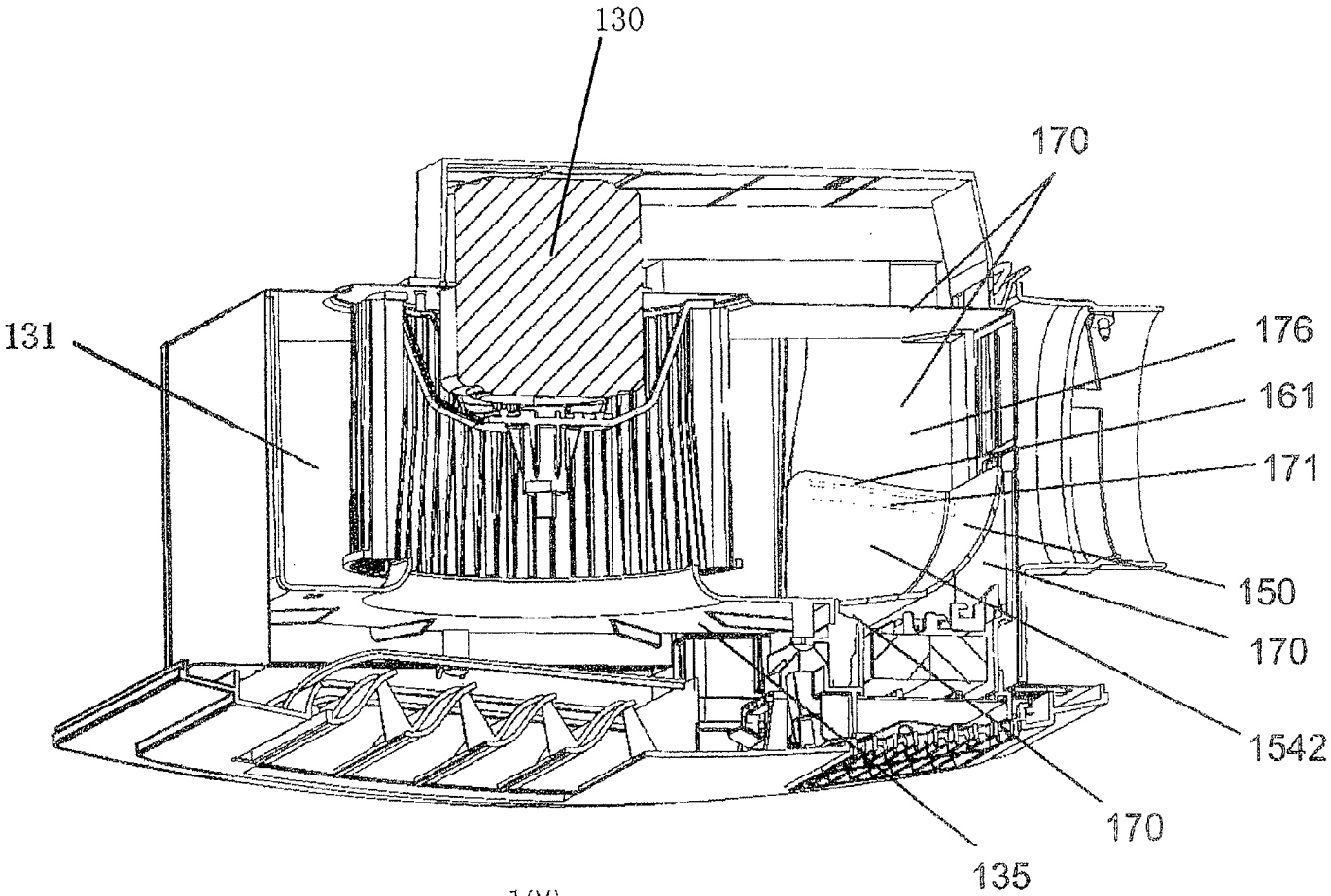

With reference to FIG. 5D, a sectional view of the heating and ventilation fan 100 for a bathroom in an air-exchanging mode is shown. By control of a step motor, the air passage-switching plate 150 is rotated to the bottom surface 135 side of the scroll casing 131. At this point, the first air passage-switching plate protrusions 161 provided on the left side surface (not shown) and the right side surface 1542 of the air passage-switching plate 150 engage with the first air passage wall protrusions 171 provided on the left side and the right side 176 of the air passage wall 170, respectively, to form a tight engagement state, so that the air can be prevented from directly flowing toward outside of the air passage-switching plate 150 from the gap between the air passage-switching plate 150 and the air passage wall 170.

Figure 6A:
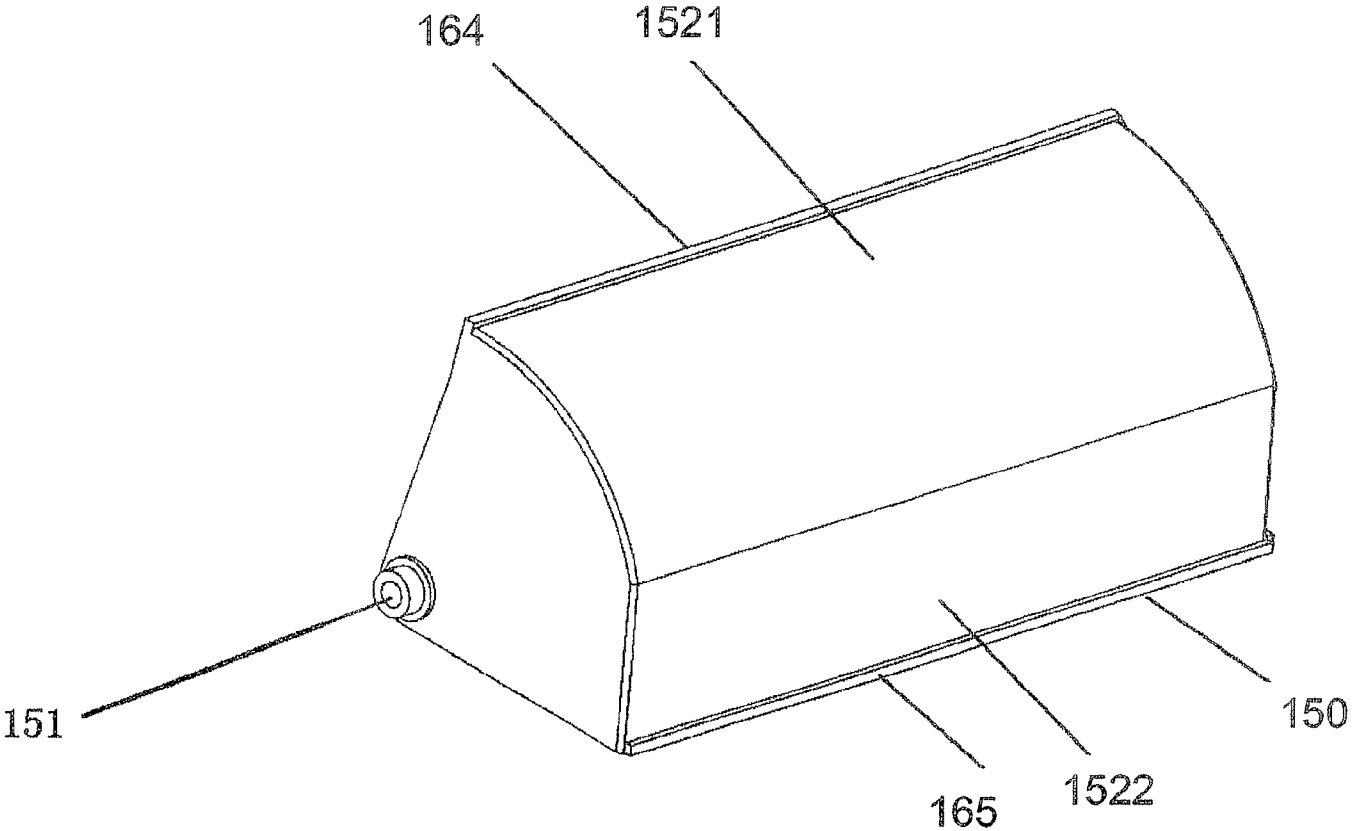
FIGS. 6A, 6B, 6C, and 6D are schematic views of a fifth embodiment.
Figure 6B:
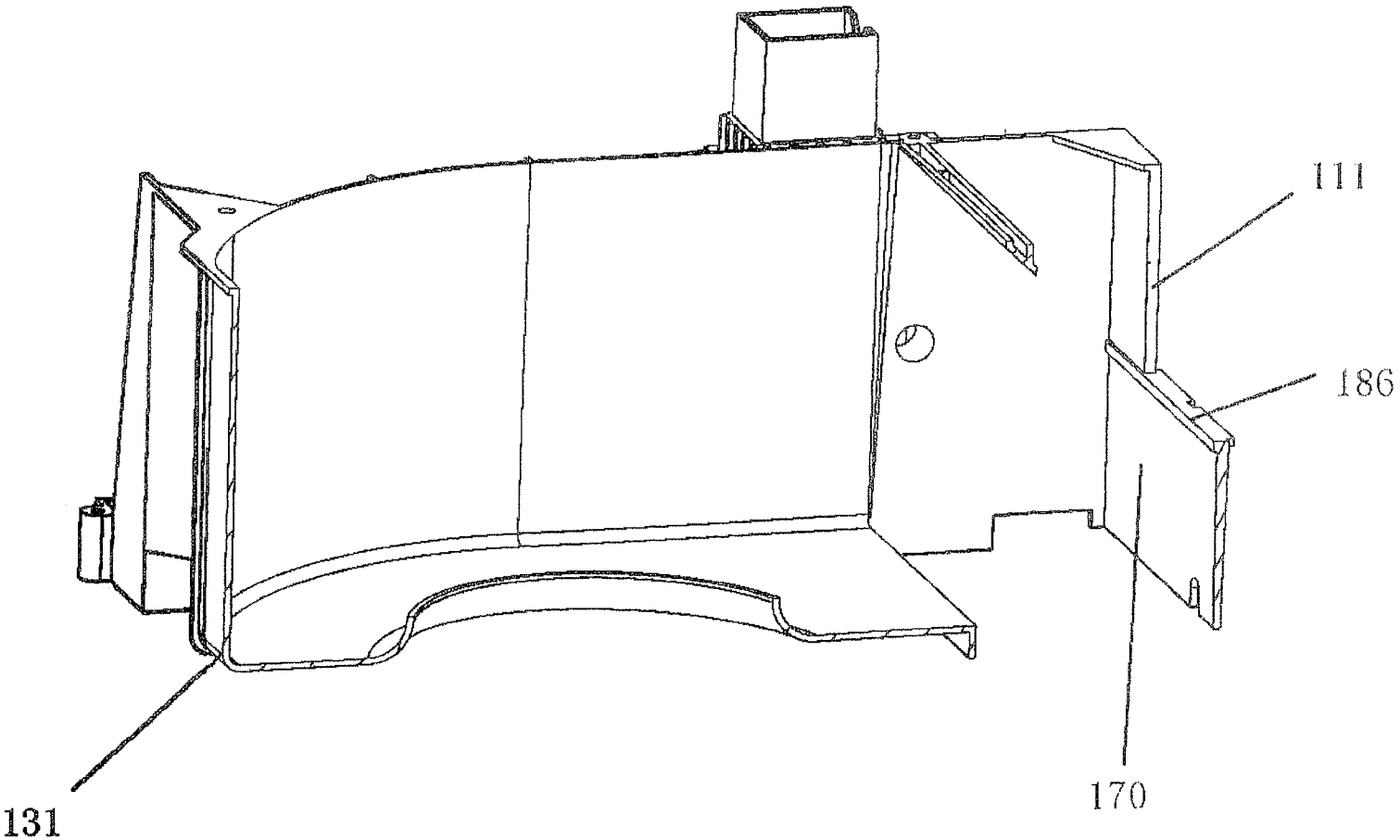

FIGS. 6A, 6B, 6C, and 6D show sectional views of a fifth embodiment of the present invention. As shown in FIGS. 6A and 6B, the front end portion 1521 and the rear end portion 1522 of the air passage-switching plate 150 are provided on the outer sides thereof with a third air passage-switching plate protrusion 164 and a fourth air passage-switching plate protrusion 165, respectively, and the third air passage-switching plate protrusion 164 and the fourth air passage-switching plate protrusion 165 face the air passage wall 170. A second air passage wall protrusion 186 is provided on the lower end, on the air outlet 111 side, of the middle portion of the air passage wall 170. Furthermore, the second air passage wall protrusion 186 is located between the third air passage-switching plate protrusion 164 and the fourth air passage-switching plate protrusion 165.

When the heating and ventilation fan is operated in the air-exchanging mode or in the heating mode, the air can be prevented from directly flowing toward outside of the air passage-switching plate 150 from the gap between the air passage-switching plate 150 and the air passage wall 170 by superposing the third air passage-switching plate protrusion 164 of the air passage-switching plate 150 and the second air passage wall protrusion 186 of the air passage wall 170 on each other and engaging the third air passage-switching plate protrusion 164 with the second air passage wall protrusion 186, or by superposing the fourth air passage-switching plate protrusion 165 and the second air passage wall protrusion 186 on each other and engaging the fourth air passage-switching plate protrusion 165 with the second air passage wall protrusion 186.

The detailed description is provided as follows.

Figure 6C:
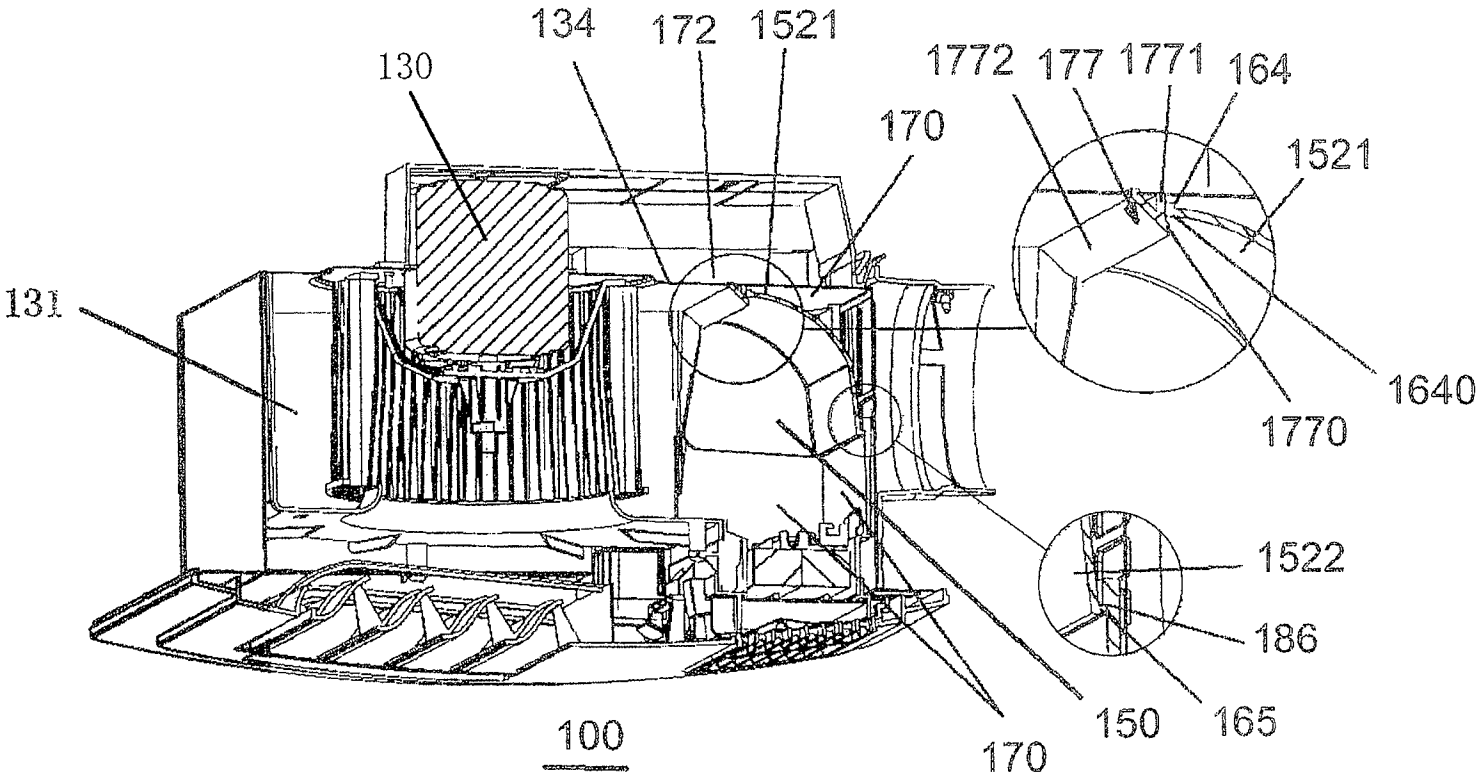

With reference to FIG. 6C, a sectional view of the heating and ventilation fan 100 for a bathroom in a heating mode is shown. By control of a step motor, the air passage-switching plate 150 is rotated to the top surface 134 side of the scroll casing 131. At this point, the fourth air passage-switching plate protrusion 165 provided on the rear end portion 1522 of the air passage-switching plate 150 engages with the second air passage wall protrusion 186 of the air passage wall 170 to form a tight engagement state, so that the air can be prevented from directly flowing toward outside of the air passage-switching plate 150 from the gap between the air passage-switching plate 150 and the air passage wall 170.

Figure 6D:
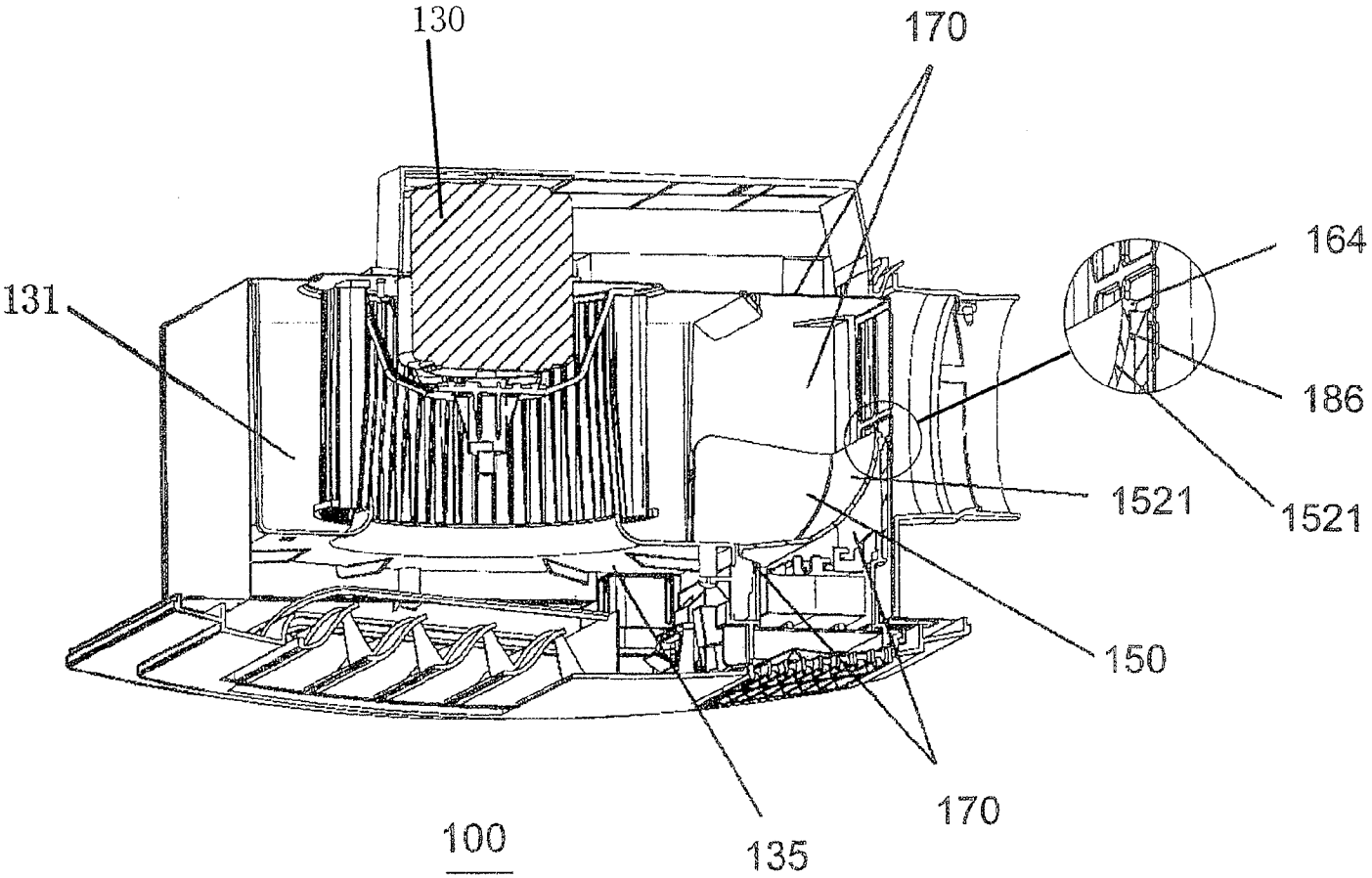

With reference to FIG. 6D, a sectional view of the heating and ventilation fan 100 for a bathroom in an air-exchanging mode is shown. By control of a step motor, the air passage-switching plate 150 is rotated to the bottom surface 135 side of the scroll casing 131. At this point, the third air passage-switching plate protrusion 164 provided on the front end portion 1521 of the air passage-switching plate 150 engages with the second air passage wall protrusion 186 of the air passage wall 170 to form a tight engagement state, so that the air can be prevented from directly flowing toward outside of the air passage-switching plate 150 from the gap between the air passage-switching plate 150 and the air passage wall 170.

With reference to FIG. 6C again, in this embodiment, the air passage wall 170 is provided on the top surface 172 side thereof with a "V"-shaped third air passage wall protrusion 177 protruding downwards, and the lowest point 1640 of the third air passage-switching plate protrusion 164 on the front end portion 1521 of the air passage-switching plate 150 is higher than the lowest point 1770 of the "V"-shaped third air passage wall protrusion 177. The third air passage wall protrusion 177 has a front side 1772 on the air outlet 132 side and a rear side 1771 downstream of the air outlet 132, and has a vertex on the lower side thereof. Moreover, the cross section of the third air passage wall protrusion 177 is in a right triangle shape, with the front side 1772 forming hypotenuse and the rear side 1771 forming a side.

When the heating and ventilation fan 100 is operated in a heating mode, the air passage-switching plate 150 is rotated to the top surface 134 side of the scroll casing 131 by control of a step motor. At this point, the third air passage-switching plate protrusion 164 on the front end portion 1521 of the air passage-switching plate 150 engages with the rear side 1771 of the third air passage wall protrusion 177, and the fourth air passage-switching plate protrusion 165 on the rear end portion 1522 of the air passage-switching plate 150 engages with the second air passage wall protrusion 186 of the air passage wall 170, so that a tight engagement state is formed. Moreover, as described above, the front side 1772 of the "V"-shaped third air passage wall protrusion 177 forms hypotenuse of the right triangle, that is, the front side 1772 also serves as a guiding plate to direct the air blown out from the air outlet side to the inside of the air passage-switching plate 150. Therefore, with the "V"-shaped third air passage wall protrusion 177, not only the air can be prevented from directly flowing toward outside of the air passage-switching plate 150 from the gap between the air passage-switching plate 150 and the air passage wall 170, but also the resistance to the air flow can be reduced and a performance can be enhanced. In this way, product performance and utilization efficiency of energy can be improved.

The sixth embodiment of the present invention is based on the above second embodiment. On the basis of the above second embodiment provided with the protrusion piece 300 as the air leakage-preventing structure, the sixth embodiment of the present invention further comprises a control unit for controlling the motor 130, the heater 140, and the air passage-switching plate 150, and a sensor for detecting the position of the air passage-switching plate 150 and sending signals to the above control unit.

During the heating operation or the air-exchanging operation, the sensor detects the position of the air passage-switching plate 150 and sends the position signals to the control unit. In a case where the position of the air passage-switching plate 150 offsets from the normal position, the control unit controls the step motor according to the position signals to rotate the air passage-switching plate to the normal position.

Since the position of the air passage-switching plate 150 can be detected, the control unit can correct the position of the air passage-switching plate 150 if the position of the air passage-switching plate 150 offsets from the normal position due to external factors during the heating operation or the air-exchanging operation.

Therefore, with the air leakage-preventing structure of the present invention, not only the air can be certainly directed into the air passage-switching plate 150, but also the air leakage caused by offset of the position of the air passage-switching plate 150 can be prevented.

Further, the sensor comprises a first body-side sensing element provided on the side face of the air passage wall 170 of the scroll casing 131 and a first air passage switching plate-side sensed element provided outside of the side plate 154 of the rotation piece 155 of the air passage-switching plate 150 and provided at a position corresponding to the position of the first body-side sensing element.

Figure 7A:
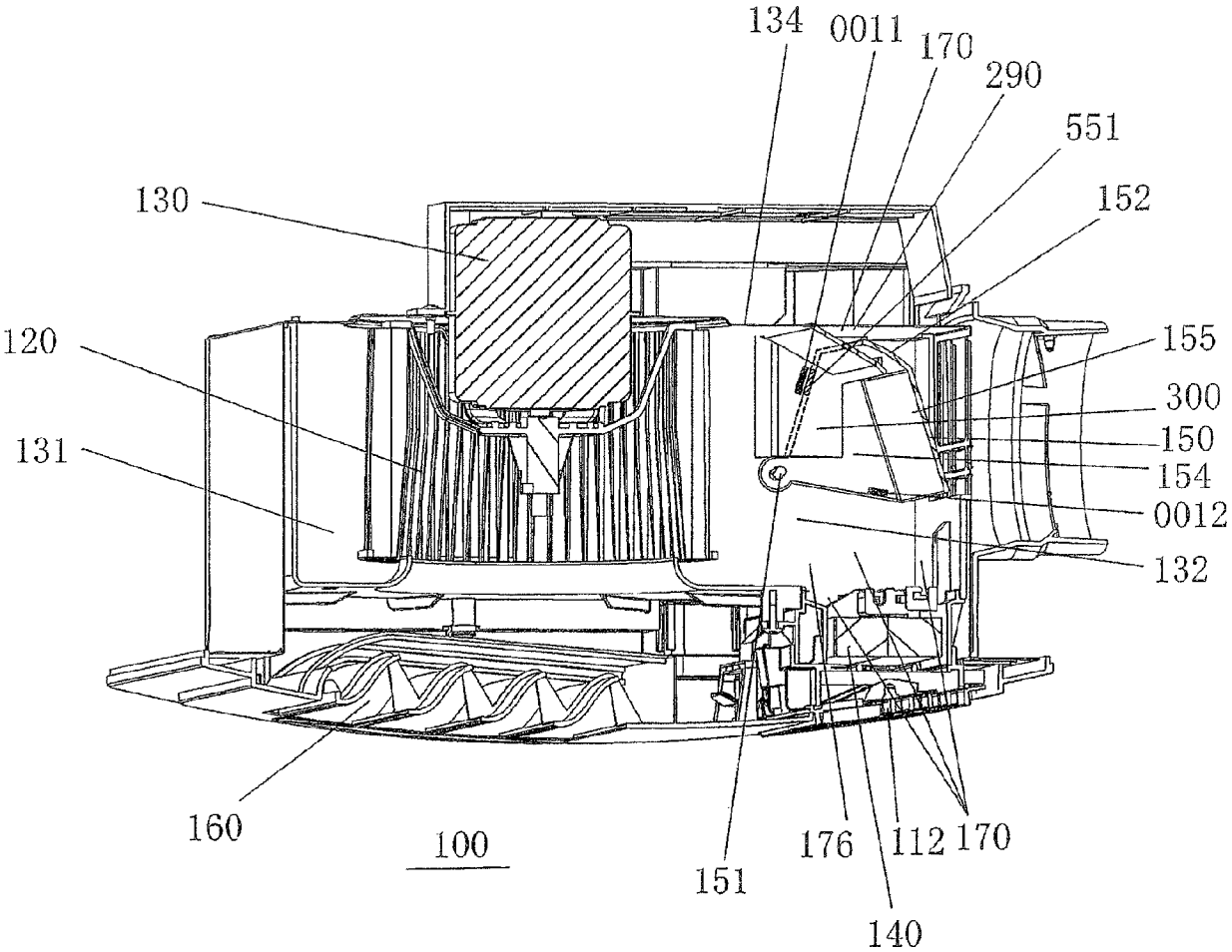
FIGS. 7A and 7B are schematic views of a first embodying example of a sixth embodiment.
Figure 7B:
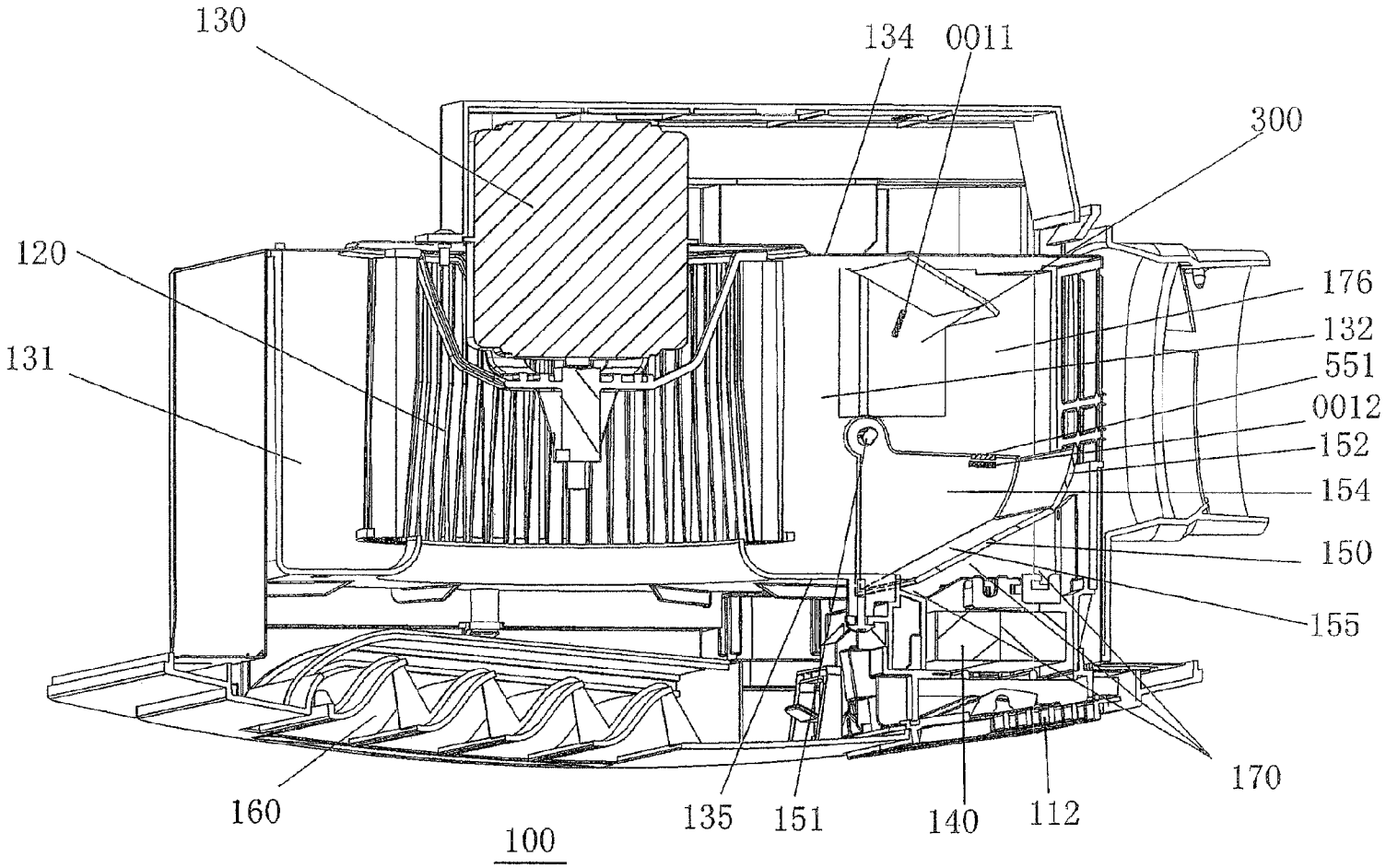

FIGS. 7A and 7B are schematic views showing the sixth embodiment in a first embodying form. As shown in FIG. 7A, the first body-side sensing elements 0011, 0012 provided on the side face of the air passage wall 170 of the scroll casing 131 are provided to correspond to movable limit points of the first air passage switching plate-side sensed elements 551 moved along with the air passage-switching plate 150.

As shown in FIG. 7A, the side plate 154 of the air passage-switching plate 150 is provided with the first air passage switching plate-side sensed element 551. In this embodying form, the first air passage switching plate-side sensed element 551 looks like a flange on an upper portion of an end surface of the side plate 154 of the air passage-switching plate 150 and is disposed along a direction radially extending from the rotation shaft 151 (at the same positions as the first air passage-switching plate protrusions in FIG. 5A).

As shown in FIG. 7A, the first body-side sensing elements 0011, 0012 are disposed along a direction radially extending from the rotation shaft 151 and are provided at two positions on the side face or side faces of the left side or right side 176 of the air passage wall 170.

The first body-side sensing elements 0011, 0012 provided at the two positions on the side face of the air passage wall 170 are provided to correspond to movable limit points of the first air passage switching plate-side sensed element 551 moved along with the air passage-switching plate 150.

That is to say, the position of the first body-side sensing element 0011 on one side of the air passage wall 170 corresponds to the position of the first air passage switching plate-side sensed element 551 on the air passage-switching plate side in the heating mode. In other words, when the air passage-switching plate 150 is rotated to the top surface 134 side of the scroll casing 131, the first air passage switching plate-side sensed element 551 provided on the upper portion of the end surface of the side plate 154 of the air passage-switching plate 150 is rotated along with the air passage-switching plate 150, and the first body-side sensing element 0011 and the first air passage switching plate-side sensed element 551 in a state of reaching the upper limit point are disposed along a direction radially extending from the rotation shaft 151 and opposite to each other.

Further, as shown in FIG. 7B, the position of the first body-side sensing element 0012 on the other side of the air passage wall 170 corresponds to the position of the first air passage switching plate-side sensed element 551 on the air passage-switching plate side in the air-exchanging mode. In other words, when the air passage-switching plate 150 is rotated to the bottom surface 135 side of the scroll casing 131, the first air passage switching plate-side sensed element 551 provided on the upper portion of the end surface of the side plate 154 of the air passage-switching plate 150 is rotated along with the air passage-switching plate 150, and the first body-side sensing element 0012 and the first air passage switching plate-side sensed element 551 in a state of reaching the lower limit point are disposed along a direction radially extending from the rotation shaft 151 and opposite to each other.

As described above, since the first body-side sensing elements 0011, 0012 provided at two positions on the side face of the air passage wall 170 are provided to correspond to the upper and lower movable limit points of the air passage switching plate-side sensed element 551, in the heating mode, when, along with rotation of the side plate 154 of the air passage-switching plate 150, the first air passage switching plate-side sensed element 551 moves up to the upper movable limit point, the normal position of the air passage-switching plate 150 operated in the heating mode is detected by means of the first body-side sensing element 0011 disposed on one side and corresponding to the upper limit point, In the air-exchanging mode, when, along with rotation of the side plate 154 of the air passage-switching plate 150, the first air passage switching plate-side sensed element 551 moves up to the lower movable limit point, the normal position of the air passage-switching plate 150 operated in the air-exchanging mode is detected by means of the first body-side sensing element 0012 disposed on the other side and corresponding to the lower limit point.

The control unit sends a signal to the step motor according to this position signal and controls rotation of the air passage-switching plate 150.

Further, the first air passage switching plate-side sensed element 551 is disposed along a direction radially extending from the rotation shaft 151 and is provided on separated locations, like a flange on the upper portion of the end surfaces of the side plates 154. If the first body-side sensing elements 0011, 0012 provided at two positions on the side face of the air passage wall 170 are disposed along a direction radially extending from the rotation shaft 15 and are provided on the separated locations, since the first body-side sensing element 0011 and the second body-side sensing element 0012 are distant from each other and will not interfere with each other when detecting the first air passage switching plate-side sensed element 551, the first air passage switching plate-side sensed element 551 can be stably detected by the first body-side sensing elements 0011, 0012.

By use of the non-contact axially-sensing operation performed by the first body-side sensing elements 0011, 0012 provided at the two positions on the side face of the air passage wall 170 and the first air passage switching plate-side sensed element 551 provided on the side plate 154 of the air passage-switching plate 150, the position of the air passage-switching plate 150 can be detected.

Since the normal position of the air passage-switching plate 150 during the drying operation and the air-exchanging operation can be accurately detected, if the position of the air passage-switching plate 150 offsets from the normal position due to the outer factors during the heating operation or the air-exchanging operation, the control unit can correct the position of the air passage-switching plate 150.

Therefore, with the air leakage-preventing structure of the present invention, not only the air can be certainly directed into the air passage-switching plate 150, but also the air leakage caused by offset of the position of the air passage-switching plate 150 can be prevented.

Figure 8:
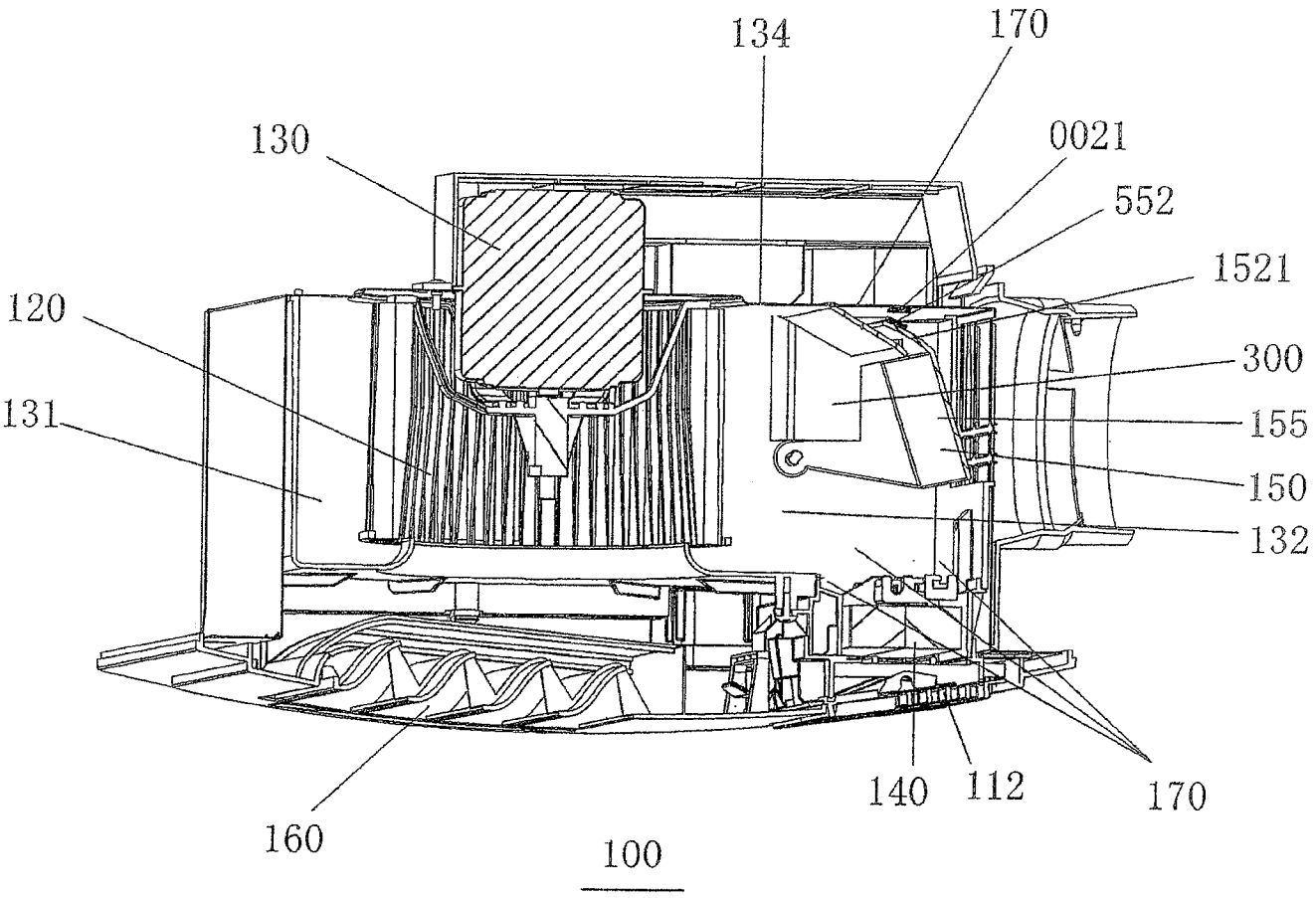
FIG. 8 is a schematic view of a second embodying example of the sixth embodiment.

FIG. 8 is a schematic view showing the sixth embodiment in a second embodying form. As shown in FIG. 8, the sensor also may comprise a second body-side sensing element 0021 provided on the top portion of the air passage wall 170 of the scroll casing 131 and a second air passage switching plate-side sensed element 552 provided outside of the front end portion 1521 of the rotation piece 155 of the air passage-switching plate 150 and located at a position corresponding to the position of the second body-side sensing element 0021.

By use of the non-contact radially-sensing operation performed by the second body-side sensing element 0021 provided on the inside of the top portion of the air passage wall 170 and the second air passage switching plate-side sensed element 552 provided on the front end portion 1521 of the air passage-switching plate 150, the normal position of the air passage-switching plate during the heating operation can be detected.

That is to say, the position of the air passage-switching plate 150 in the heating mode is such arranged that when the air passage-switching plate 150 is rotated to the top 134 side of the scroll casing 131, the second body-side sensing element 0021 and the second air passage switching plate-side sensed element 552 provided on the front end portion 1521 of the air passage-switching plate 150 are disposed along two opposite directions.

The second body-side sensing element 0021 and the second air passage switching plate-side sensed element 552 may be provided at any position on the inside surface of the top portion of the air passage wall 170 and at any position on the outside surface of the front end portion 1521 of the air passage-switching plate 150, respectively. The two elements are disposed along two opposite directions when being in the heating mode.

The control unit sends a signal to the step motor according to the position signal from the second body-side sensing element 0021 and the second air passage switching plate-side sensed element 552 and controls rotation of the air passage-switching plate.

In a case where the position of the air passage-switching plate 150 offsets from the normal position due to the outer factors during the heating operation, the control unit can correct the position of the air passage-switching plate 150.

Therefore, with the air leakage-preventing structure of the present invention, not only the air can be certainly directed into the air passage-switching plate 150, but also the air leakage caused by offset of the position of the air passage-switching plate 150 can be effectively prevented.

Figure 9:
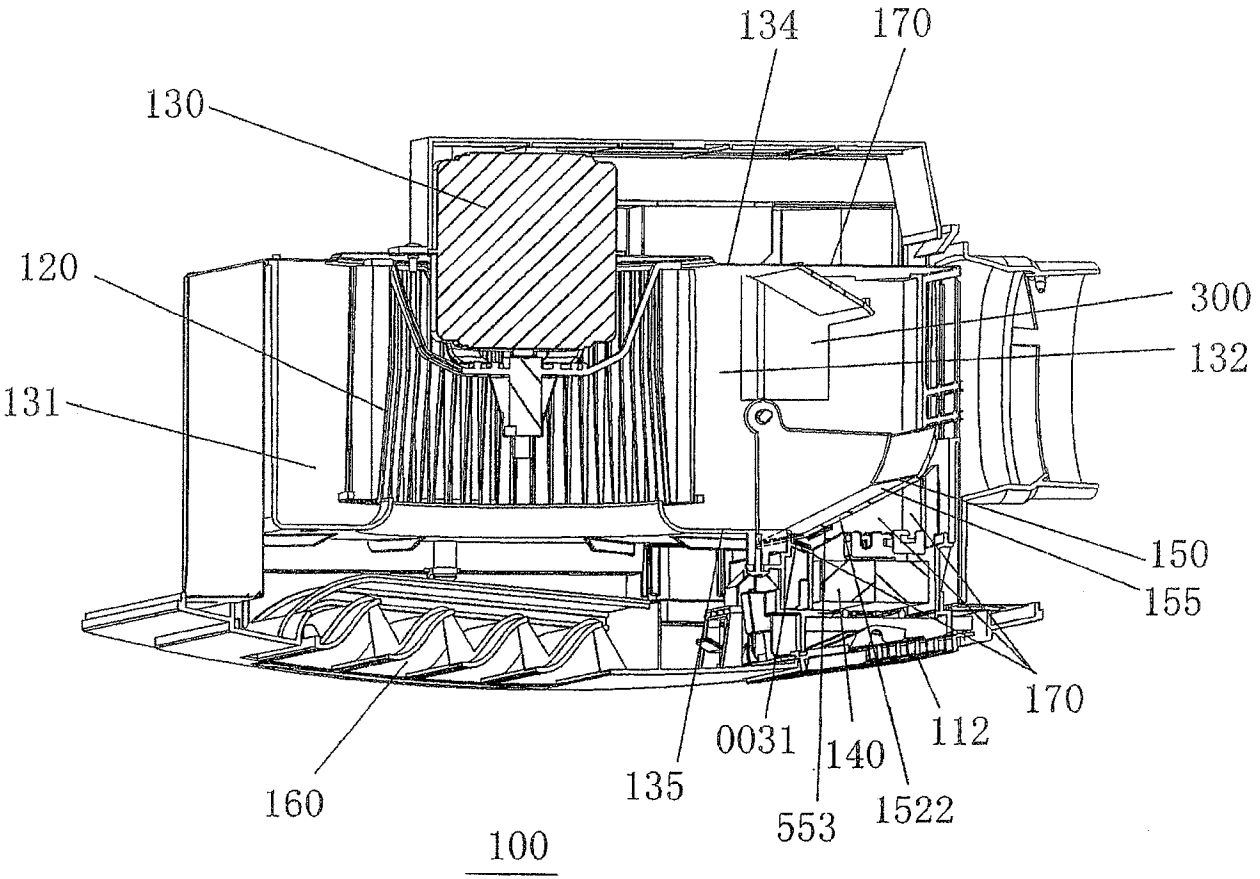
FIG. 9 is a schematic view of a third embodying example of the sixth embodiment.

FIG. 9 is a schematic view showing the sixth embodiment in a third embodying form. As shown in FIG. 9, the sensor may comprise a third body-side sensing element 0031 provided on the bottom portion of the air passage wall 170 of the scroll casing 131 and a third air passage switching plate-side sensed element 553 provided outside of the rotation piece 155 of the air passage-switching plate 150 and located at a position corresponding to the position of the third body-side sensing element 0031.

By use of the non-contact radially-sensing operation performed by the third body-side sensing element 0031 provided on the inside of the bottom portion of the air passage wall 170 and the third air passage switching plate-side sensed element 553 provided on the rear end portion 1522 of the air passage-switching plate 150, the normal position of the air passage-switching plate during the air-exchanging operation can be detected.

That is to say, the position of the air passage-switching plate 150 in the air-exchanging mode is such arranged that when the air passage-switching plate 150 is rotated to the bottom 135 side of the scroll casing 131, the third body-side sensing element 0031 and the third air passage switching plate-side sensed element 553 provided on the rear end portion 1522 of the air passage-switching plate 150 are disposed along two opposite directions.

The third body-side sensing element 0031 and the third air passage switching plate-side sensed element 553 may be provided at any position on the inside surface of the bottom portion of the air passage wall 170 and at any position on the outside surface of the rear end portion 1522 of the air passage-switching plate 150, respectively. The two elements are disposed along two opposite directions when being in the air-exchanging mode.

The control unit sends a signal to the step motor according to the position signal from the third body-side sensing element 0031 and the third air passage switching plate-side sensed element 553 and controls rotation of the air passage-switching plate.

The normal position of the air passage-switching plate 150 during the air-exchanging operation can be accurately detected.

In a case where the position of the air passage-switching plate 150 offsets from the normal position due to the outer factors during the air-exchanging operation, the control unit can correct the position of the air passage-switching plate 150.

Therefore, with the air leakage-preventing structure of the present invention, not only the air can be certainly directed into the air passage-switching plate 150, but also the air leakage caused by offset of the position of the air passage-switching plate 150 can be effectively prevented.

Further, the first, second, and third body-side sensing elements may be magnetic sensors, and the first, second, and third air passage switching plate-side sensed elements may be magnets.

The first body-side sensing element, the second body-side sensing element, and the third body-side sensing element are hole elements in the magnetic sensors. Moreover, the first, second, and third air passage switching plate-side sensed elements are magnets.

With rotation of the air passage-switching plate 150, when the first, second, and third air passage switching plate-side sensed elements enter into the detection range of the first, second, and third body-side sensing element, the magnetic sensor can detect a magnetic field generated by the magnet.

The first, second, and third body-side sensing elements may be magnetic sensors using hole elements. If magnets are used as the first, second, and third air passage switching plate-side sensed elements, the first, second, and third air passage switching plate-side sensed elements are non-contacting compared with a mechanical switch and may facilitate miniaturization of the sensor.

Further, the above described magnetic sensor (the first, second, and third body-side sensing elements) may be an electromagnet.

That is, the first, second, and third body-side sensing elements may be electromagnets.

With rotation of the air passage-switching plate 150, when the first, second, and third air passage switching plate-side sensed elements enter into the detection range of the first, second, and third body-side sensing elements, the magnetic field of the magnet will change, and the coil of the electromagnet will generate a voltage.

During the air-exchanging operation or the heating operation, when the control unit controls the step motor to rotate the air passage-switching plate, the first, second, and third body-side sensing elements first detect that the magnets (the first, second, and third air passage switching plate-side sensed elements) enter into the detection range of the electromagnet. Then, the magnetic sensors on the body side for the electromagnet (the first, second, and third body-side sensing elements) are switched on and the air passage-switching plate 150 is rotated to the vicinity of the normal position during the air-exchanging operation or the heating operation. The magnetic sensors on the body side (the first body-side sensing element, the second body-side sensing element) will attract the magnets on the air passage-switching plate 150 side (the first air passage switching plate-side sensed element and the second air passage switching plate-side sensed element).

The air passage-switching plate 150 can be ensured to be retained in the normal position during the heating operation and the air-exchanging operation. If the position of the air passage-switching plate 150 offsets from the normal position, the position of the air passage-switching plate 150 can be adjusted to the normal position and then be locked.

Further, the air leakage-preventing structure according to the sixth embodiment is a structure having the protrusion piece 300 of the second embodiment, or an embodying form of any one of the first embodiment, the second embodiment, and the fifth embodiment in combination of the air leakage-preventing structure. With the control unit and the sensor according to the sixth embodiment and the air leakage-preventing structure according to the embodiments, not only the air can be certainly directed into the air passage-switching plate 150, but also the air leakage caused by position offset of the air passage-switching plate 150 toward the air-exchanging position side due to the self weight thereof during the heating operation can be effectively prevented and the air leakage caused by position offset of the air passage-switching plate 150 due to the air pressure during the air-exchanging operation can be effectively prevented.

What is claimed is:

1. A heating and ventilation fan for a bathroom, comprising a ventilation fan frame, a scroll casing provided with fan blades and a motor, an air passage-switching plate provided downstream of an air outlet of the scroll casing and configured to switch air passages directed in at least two directions, and a heater;

an air leakage-preventing structure is provided at the air outlet of the scroll casing to direct the air to an inside of the air passage-switching plate;

wherein the air leakage-preventing structure comprises a protrusion piece configured to protrude from the air outlet of the scroll casing to the inside of the air passage-switching plate, and the air passage-switching plate has a rotation piece configured to overlap with an outer side of the protrusion piece, wherein an air passage wall forming an air passage extends from the air outlet of the scroll casing, and a gap for receiving the rotation piece of the air passage-switching plate is formed between the protrusion piece and the air passage wall of the air passage downstream of the air outlet of the scroll casing.

2. The heating and ventilation fan for a bathroom according to claim 1, characterized in that: the protrusion piece is provided at the periphery of the whole air outlet of the scroll casing.

3. The heating and ventilation fan for a bathroom according to claim 1, characterized in that: the protrusion piece is protruded from a position higher than the position at which a rotation shaft, passing across the air outlet of the scroll casing, of the air passage-switching plate is located.

4. The heating and ventilation fan for a bathroom according to claim 1, characterized in that: the protrusion piece is protruded from a position lower than the position at which a rotation shaft, passing across the air outlet of the scroll casing, of the air passage-switching plate is located.

5. A heating and ventilation fan for a bathroom, comprising a ventilation fan frame, a scroll casing providing with fan blades and a motor, an air passage-switching plate provided downstream of an air outlet of the scroll casing and configured to switch air passages directed in at least two directions, and a heater;

an air leakage-preventing structure is provided at the air outlet of the scroll casing to direct the air to an inside of the air passage-switching plate;

wherein the air leakage-preventing structure comprises a protrusion piece configured to protrude from the air outlet of the scroll casing to the inside of the air passage-switching plate, and the air passage-switching plate has a rotation piece configured to overlap with an outer side of the protrusion piece, wherein the heating and ventilation fan further comprises a control unit for controlling the motor, the heater, and the air passage-switching plate and a sensor for detecting the position of the air passage-switching plate and sending a signal to the control unit.

6. The heating and ventilation fan for a bathroom according to claim 5, characterized in that: the sensor comprises a first body-side sensing element provided on the side face of the air passage wall of the scroll casing and a first air passage switching plate-side sensed element provided outside of the rotation piece of the air passage-switching plate and provided at a position corresponding to the position of the first body-side sensing element.

7. The heating and ventilation fan for a bathroom according to claim 6, characterized in that: the first body-side sensing element is provided to correspond to movable limit points of the first air passage switching plate-side sensed elements moved along with the air passage-switching plate.

8. The heating and ventilation fan for a bathroom according to claim 5, characterized in that: the sensor comprises a second body-side sensing element provided on a top portion of the air passage wall of the scroll casing and a second air passage switching plate-side sensed element provided outside of the rotation piece of the air passage-switching plate and located at a position corresponding to the position of the second body-side sensing element.

9. The heating and ventilation fan for a bathroom according to claim 5, characterized in that: the sensor comprises a third body-side sensing element provided on a bottom portion of the air passage wall of the scroll casing and a third air passage switching plate-side sensed element provided outside of a rotation piece of the air passage-switching plate and located at a position corresponding to the position of the third body-side sensing element.

10. A heating and ventilation fan for a bathroom, comprising a ventilation fan frame, a scroll casing provided with fan blades and a motor, an air passage-switching plate provided downstream of an air outlet of the scroll casing and configured to switch air passages directed in at least two directions, and a heater;

an air leakage-preventing structure is provided at the air outlet of the scroll casing to direct the air to an inside of the air passage-switching plate, and the air leakage-preventing structure comprises protruding structures provided on the air passage-switching plate and on an air passage wall forming the air passage and operable to be engaged with each other.

11. The heating and ventilation fan for a bathroom according to claim 10, characterized in that: the protruding structures comprise protrusions provided on the left and right sides of the air passage-switching plate and of the air passage wall, respectively, and the protrusions on the air passage-switching plate and the protrusions on the air passage wall can be engaged with each other.

12. The heating and ventilation fan for a bathroom according to claim 10, characterized in that: the protrusions of the air passage-switching plate comprise a first air passage-switching plate protrusion and a second air passage-switching plate protrusion provided on side plates of the air passage-switching plate adjoining the air passage wall, respectively, and the protrusions of the air passage wall comprise a first air passage wall protrusion provided at the middle of the air passage wall.

13. The heating and ventilation fan for a bathroom according to claim 10, characterized in that: the protrusions of the air passage-switching plate comprise a third air passage-switching plate protrusion and a fourth air passage-switching plate protrusion provided on a front end portion and a rear end portion of the air passage-switching plate adjoining the air passage wall, respectively, and the protrusions of the air passage wall comprise a second air passage wall protrusion provided at the middle of the air passage wall on the air outlet side.

14. The heating and ventilation fan for bathroom according to claim 13, characterized in that: a third air passage wall protrusion is provided on a top surface side of the air passage wall, and the lowest point of the third air passage-switching plate protrusion is higher than the lowest point of the third air passage wall protrusion.

15. The heating and ventilation fan for a bathroom according to claim 10, characterized in that: the heating and ventilation fan further comprises a control unit for controlling the motor, the heater, and the air passage-switching plate and a sensor for detecting the position of the air passage-switching plate and sending a signal to the control unit.

16. The heating and ventilation fan for a bathroom according to claim 15, characterized in that: the sensor comprises a first body-side sensing element provided on the side face of the air passage wall of the scroll casing and a first air passage switching plate-side sensed element provided outside of a rotation piece of the air passage-switching plate and provided at a position corresponding to the position of the first body-side sensing element.

17. The heating and ventilation fan for a bathroom according to claim 16, characterized in that: the first body-side sensing element is provided to correspond to movable limit points of the first air passage switching plate-side sensed elements moved along with the air passage-switching plate.

18. The heating and ventilation fan for a bathroom according to claim 15, characterized in that: the sensor comprises a second body-side sensing element provided on a top portion of the air passage wall of the scroll casing and a second air passage switching plate-side sensed element provided outside of a rotation piece of the air passage-switching plate and located at a position corresponding to the position of the second body-side sensing element.

19. The heating and ventilation fan for a bathroom according to claim 15, characterized in that: the sensor comprises a third body-side sensing element provided on a bottom portion of the air passage wall of the scroll casing and a third air passage switching plate-side sensed element provided outside of a rotation piece of the air passage-switching plate and located at a position corresponding to the position of the third body-side sensing element.

* * * * *